US007172395B2

(12) United States Patent
Shibamoto et al.

(10) Patent No.: US 7,172,395 B2
(45) Date of Patent: Feb. 6, 2007

(54) SCROLL-TYPE FLUID MACHINE

(75) Inventors: Yoshitaka Shibamoto, Sakai (JP); Ryogo Kato, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 10/565,842

(22) PCT Filed: Jul. 26, 2004

(86) PCT No.: PCT/JP2004/010625

§ 371 (c)(1),
(2), (4) Date: Jan. 26, 2006

(87) PCT Pub. No.: WO2005/010371

PCT Pub. Date: Mar. 2, 2005

(65) Prior Publication Data

US 2006/0182645 A1 Aug. 17, 2006

(30) Foreign Application Priority Data

Jul. 28, 2003 (JP) ..... 2003-281171
Aug. 11, 2003 (JP) ..... 2003-291043

(51) Int. Cl.
*F03C 2/00* (2006.01)
*F04C 18/00* (2006.01)
*F04C 18/02* (2006.01)

(52) U.S. Cl. ..... 418/60; 418/55.1; 418/55.3; 464/102

(58) Field of Classification Search ..... 418/5, 418/60, 55.1–55.6, 57
See application file for complete search history.

(56) References Cited

U.S. PATENT DOCUMENTS 3,560,119 A * 2/1971 Busch et al. ..... 418/55.3
4,192,152 A * 3/1980 Armstrong et al. ..... 418/5
4,650,405 A * 3/1987 Iwanami et al. ..... 418/60

FOREIGN PATENT DOCUMENTS

EP 529660 A1 * 3/1993
JP 5-312160 A 11/1993
JP 7-133770 A 5/1995
JP 9-126164 A 5/1997
JP 2002-235682 A 8/2002

* cited by examiner

*Primary Examiner*—Theresa Trieu
(74) *Attorney, Agent, or Firm*—Birch, Stewart, Kolasch & Birch, LLP

(57) ABSTRACT

A fixed scroll (40) is provided which is made up of a first stationary-side member (41) and a second stationary-side member (46). The first stationary-side member (41) has a first stationary-side wrap (42) and a first outer peripheral part (43) encompassing the first stationary-side wrap (42). The second stationary-side member (46) has a second stationary-side wrap (47), a second outer peripheral part (48), and a third flat-plate part (49). The second stationary-side wrap (47) is formed integrally with the third flat-plate part (49). An orbiting scroll (50) is provided which has a first flat-plate part (51), a first movable-side wrap (53), a second flat-plate part (52), and a second movable-side wrap (54). The first movable-side wrap (53) is formed integrally with the first flat-plate part (51). The second movable-side wrap (54) is formed integrally with the second flat-plate part (52). A bearing part (64) is formed in the back surface of the first flat-plate part (51), and an eccentric part (21) of a drive shaft (20) is inserted into the bearing part (64).

11 Claims, 15 Drawing Sheets

SCROLL-TYPE FLUID MACHINE

TECHNICAL FIELD

The present invention relates to scroll type fluid machinery.

BACKGROUND ART

Scroll type fluid machines are well known in the conventional art, and they are utilized in various applications, such as a compressor for refrigerant compression in a refrigeration apparatus. For example, JP Patent Application Kokai Pub. No. 1997-126164 and JP Patent Application Kokai Pub. No. 2002-235682A disclose scroll type fluid machines having movable- and stationary-side wraps, wherein the movable- and stationary-side wraps are arranged in two sets and brought into engagement with each other. In such a scroll type fluid machine, both surfaces of a flat-plate part in an orbiting scroll are provided with respective spiral wraps vertically arranged. More specifically, in the scroll type fluid machine, a movable-side wrap vertically arranged on the front surface of the flat-plate part engages a first stationary-side wrap to form a first fluid chamber while on the other hand a movable-side wrap vertically arranged on the back surface of the flat-plate part engages a second stationary-side wrap to form a second fluid chamber.

In such a type of scroll type fluid machine, however, it is required that its rotating shaft be brought into engagement with an orbiting scroll having a flat-plate part both surfaces of which are provided with vertically-arranged wraps. To this end, the aforesaid publication 1997-126164 shows a technique in which a rotating shaft is disposed, such that it passes through the center of a flat-plate part in an orbiting scroll and an eccentric part of the rotating shaft is brought into engagement with the flat-plate part. On the other hand, the aforesaid publication 2002-235682 shows a technique in which an insertion part is formed, such that it passes through the center of a flat-plate part in an orbiting scroll and an eccentric part of a rotating shaft is inserted into the shaft insertion part from the back surface side of the flat-plate part.

Problems that Invention Intends to Solve

As discussed above, in a scroll type fluid machine in which both surfaces of a flat-plate part in an orbiting scroll are provided with respective vertically-arranged wraps, the rotating shaft has to come into engagement with the orbiting scroll. This makes it impossible to provide wraps in the center of a flat-plate part in an orbiting scroll. This results in increasing the minimum volume of a fluid chamber formed by a movable-side wrap and a stationary-side wrap. And, when trying to obtain a certain degree of compression ratio or expansion ratio, the fluid chamber has to be designed so as to increase in its maximum volume by increasing the outermost diameter of spiral wraps. This increases the size of movable and fixed scrolls on which wraps are provided, thereby causing the problem that the size of scroll type fluid machinery increases.

With the above-described problems in mind, the present invention was made. Accordingly, an object of the present invention is to achieve the downsizing of scroll type fluid machinery in which fluid chambers are formed by stationary- and movable-side wraps arranged in two sets.

Disclosure of Invention

A first invention is directed to a scroll type fluid machine comprising a fixed scroll (40), an orbiting scroll (50), a rotating shaft (20) which engages the orbiting scroll (50), and a self-rotation preventing mechanism (39) for preventing the orbiting scroll (50) from rotating. And, in the scroll type fluid machine of the first invention, the fixed scroll (40) comprises a first stationary-side member (41) provided with a first stationary-side wrap (42), and a second stationary-side member (46) provided with a second stationary-side wrap (47). The orbiting scroll (50) comprises: a first flat-plate part (51) having a back surface on which is provided an engaging part (64) which engages the rotating shaft (20), and a front surface which comes into sliding contact with the first stationary-side wrap (42); a first movable-side wrap (53) which forms a first fluid chamber (71) when engaged with the first stationary-side wrap (42); a second flat-plate part (52) which faces the first flat-plate part (51) across the first movable-side wrap (53) and which has a rear surface coming into sliding contact with the first stationary-side wrap (42) and a front surface coming into sliding contact with the second stationary-side wrap (47); and a second movable-side wrap (54) which forms a second fluid chamber (72) when engaged with the second stationary-side wrap (47). The second stationary-side member (46) is provided with a third flat-plate part (49) which faces the second flat-plate part (52) across the second movable-side wrap (54) and which comes into sliding contact with the second movable-side wrap (54).

A second invention is directed to a scroll type fluid machine comprising a fixed scroll (40), an orbiting scroll (50), a rotating shaft (20) which engages the orbiting scroll (50), and a self-rotation preventing mechanism (39) for preventing the orbiting scroll (50) from rotating. And, in the scroll type fluid machine of the second invention, the fixed scroll (40) comprises a first stationary-side member (41) provided with a first stationary-side wrap (42), and a second stationary-side member (46) provided with a second stationary-side wrap (47). The orbiting scroll (50) comprises: a first flat-plate part (51) having a back surface on which is provided an engaging part (64) which engages the rotating shaft (20), and a front surface which comes into sliding contact with the first stationary-side wrap (42); a first movable-side wrap (53) which forms a first fluid chamber (71) when engaged with the first stationary-side wrap (42); a second flat-plate part (52) which faces the first flat-plate part (51) across the first movable-side wrap (53) and which has a rear surface coming into sliding contact with the first stationary-side wrap (42) and a front surface coming into sliding contact with the second stationary-side wrap (47); a second movable-side wrap (54) which forms a second fluid chamber (72) when engaged with the second stationary-side wrap (47); and a third flat-plate part (49) which faces the second flat-plate part (52) across the second movable-side wrap (54) and which comes into sliding contact with the second stationary-side wrap (47).

A third invention according to the scroll type fluid machine of the first or second invention is characterized in that the first movable-side wrap (53) is formed integrally with the first flat-plate part (51), and that the second flat-plate part (52) is formed as a different body from the first flat-plate part (51) and the first movable-side wrap (53).

A fourth invention according to the scroll type fluid machine of the third invention is characterized in that the second movable-side wrap (54) is formed integrally with the second flat-plate part (52).

A fifth invention according to the scroll type fluid machine of the first or second invention is characterized in that the spiral direction of the first stationary- and movable-side wraps (42, 53) differs from the spiral direction of the second stationary- and movable-side wraps (47, 54).

A sixth invention according to the scroll type fluid machine of the five invention is characterized in that, when the orbiting scroll (50) makes an orbital motion, fluid compression takes place in the first fluid chamber (71) while fluid expansion takes place in the second fluid chamber (72).

A seventh invention according to the scroll type fluid machine of the sixth invention is characterized in that plural introduction openings (66, 68, 69) in communication with the second fluid chamber (72) are formed in different positions of the third flat-plate part (49) relative to the radial direction of the second stationary-side wrap (47) or relative to the radial direction of the second movable-side wrap (54), and that an opening/closing mechanism (85) for opening and closing each introduction opening (66, 68, 69) is provided.

An eighth invention according to the scroll type fluid machine of the first or second invention is characterized in that the spiral direction of the first stationary- and movable-side wraps (42, 53) is the same as the spiral direction of the second stationary- and movable-side wraps (47, 54).

A ninth invention according to the scroll type fluid machine of the eighth invention is characterized in that the ratio of maximum to minimum of the volume of the first fluid chamber (71) differs from the ratio of maximum to minimum of the volume of the second fluid chamber (72).

A tenth invention according to the scroll type fluid machine of the eighth invention is characterized in that the ratio of maximum to minimum of the volume of the first fluid chamber (71) is the same as the ratio of maximum to minimum of the volume of the second fluid chamber (72).

An eleventh invention according to the scroll type fluid machine of the eighth invention is characterized in that a fluid compressed in either one of the first and second fluid chambers (71, 72) is introduced into the other fluid chamber for further compression.

Working Operation

In the first and second inventions, the orbiting scroll (50) is guided by the self-rotation preventing mechanism (39) and rotates. The self-rotating motion of the orbiting scroll (50) is regulated, and the orbiting scroll (50) makes only orbital motion. With the orbital motion of the orbiting scroll (50), the volume of each of the first and second fluid chambers (71, 72) varies. In the orbiting scroll (50), the engaging part (64) is provided in the back surface of the first flat-plate part (51), and the engaging part (64) engages the rotating shaft (20).

Furthermore, in the first and second inventions, the first movable-side wrap (53) is provided on the front surface side of the first flat-plate part (51). The first fluid chamber (71) is formed by engagement of the first movable-side wrap (53) with the first stationary-side wrap (42) of the first stationary-side member (41). One end surface of the first stationary-side wrap (42) comes into sliding contact with the front surface of the first flat-plate part (51). The other end surface of the first stationary-side wrap (42) comes into sliding contact with the back surface of the second flat-plate part (52). The first fluid chamber (71) is divided into compartments by the first movable-side wrap (53), the first stationary-side wrap (42), the first flat-plate part (51), and the second flat-plate part (52).

In the first invention, the second movable-side wrap (54) is provided on the front surface side of the second flat-plate part (52). The second fluid chamber (72) is formed by engagement of the second movable-side wrap (54) with the second stationary-side wrap (47) of the second stationary-side member (46). The tip surface of the second movable-side wrap (54) comes into sliding contact with the third flat-plate part (49) of the second stationary-side member (46). The tip surface of the second stationary-side wrap (47) comes into sliding contact with the front surface of the second flat-plate part (52). The second fluid chamber (72) is divided into compartments by the second movable-side wrap (54), the second stationary-side wrap (47), the second flat-plate part (52), and the third flat-plate part (49).

In the second invention, the second movable-side wrap (54) is provided on the front surface side of the second flat-plate part (52). The second fluid chamber (72) is formed by engagement of the second movable-side wrap (54) with the second stationary-side wrap (47) of the second stationary-side member (46). On end surface of the second stationary-side wrap (47) comes into sliding contact with the front surface of the second flat-plate part (52). The other end surface of the second stationary-side wrap (47) comes into sliding contact with the third flat-plate part (49). The second fluid chamber (72) is divided into compartments by the second movable-side wrap (54), the second stationary-side wrap (47), the second flat-plate part (52), and the third flat-plate part (49).

It should be noted that, in the first and second inventions, the end surface of the first stationary-side wrap (42) and the front surface of the first flat-plate part (51) do not necessarily come into direct contact with each other. In other words, strictly speaking, even when there is a very small gap between the first stationary-side wrap (42) and the first flat-plate part (51), it suffices if the first stationary-side wrap (42) and the first flat-plate part (51) are in such a state that they seem to be in friction with each other. This is applied likewise to the state of contact between the end surface of the first stationary-side wrap (42) and the front surface of the second flat-plate part (52) and to the state of contact between the end surface of the second stationary-side wrap (47) and the front surface of the second flat-plate part (52) and, in the first invention, to the state of contact between the end surface of the second movable-side wrap (54) and the third flat-plate part (49) and, in the second invention, to the state of contact between the end surface of the second stationary-side wrap (47) and the third flat-plate part (49).

In the third invention, the first movable-side wrap (53) is formed integrally on the front surface side of the first flat-plate part (51). In the orbiting scroll (50), the second flat-plate part (52) is attached to the first flat-plate part (51) or to the first movable-side wrap (53).

In the fourth invention, the second movable-side wrap (54) is formed integrally on the front surface side of the second flat-plate part (52). In the orbiting scroll (50), the second flat-plate part (52) formed integrally with the second movable-side wrap (54) is attached to the first flat-plate part (51) or to the first movable-side wrap (53).

In the fifth invention, the first stationary- and movable-side wraps (42, 53), and the second stationary- and movable-side wraps (47, 54) spiral in opposite directions. For example, if the first stationary- and movable-side wraps (42, 53) are each shaped like a right-handed spiral, then the second stationary- and movable-side wraps (47, 54) are each shaped like a left-handed spiral. During the orbital motion of the orbiting scroll (50), fluid compression takes place in the inside of either one of the first fluid chamber (71) lying between the first stationary-side wrap (42) and the first movable-side wrap (53) and the second fluid chamber (72) lying between the second stationary-side wrap (47) and the second movable-side wrap (54) while simultaneously fluid expansion takes place in the inside of the other fluid chamber. Stated another way, for example, if fluid is drawn into the first fluid chamber (71) where it is compressed, fluid fed into the second fluid chamber (72) expands.

In the sixth invention, during the orbital motion of the orbiting scroll (50), fluid is drawn into the first fluid chamber (71) where it is compressed while on the other hand fluid fed into the second fluid chamber (72) expands.

In the seventh invention, the plural introduction openings (66, 68, 69) are formed in the third flat-plate part (49). Each introduction opening (66, 68, 69) is placed in the open or closed state by the opening/closing mechanism (85). Fluid flows, through the introduction openings (66, 68, 69) in the open state, into the second fluid chamber (72). In addition, in the seventh invention, the introduction openings (66, 68, 69) are formed at different positions in the third flat-plate part (49) relative to the radial direction of the second stationary-side wrap (47) or relative to the radial direction of the second movable-side wrap (54). Accordingly, the second fluid chambers (72), to which the introduction openings (66, 68, 69) open, differ from each other in volume depending on the introduction openings (66, 68, 69). Therefore, if the introduction openings (66, 68, 69) for the passage of fluid are changed, the second fluid chambers (72) vary in volume at the time of fluid introduction.

In the eighth invention, the spiral direction of the first stationary- and movable-side wraps (42, 53) is the same as the spiral direction of the second stationary- and movable-side wraps (47, 54). For example, if the first stationary- and movable-side wraps (42, 53) are each shaped like a right-handed spiral, then the second stationary- and movable-side wraps (47, 54) are each also shaped like a right-handed spiral. During the orbital motion of the orbiting scroll (50), fluid compression or fluid expansion takes place in the inside of the first fluid chamber (71) lying between the first stationary-side wrap (42) and the first movable-side wrap (53) as well as in the inside of the second fluid chamber (72) lying between the second stationary-side wrap (47) and the second movable-side wrap (54). Stated another way, for example, if fluid is drawn into the first fluid chamber (71) where it is compressed, fluid is drawn also into the second fluid chamber (72) where it is compressed.

In the ninth invention, the ratio of maximum to minimum of the volume of the first fluid chamber (71) differs from the ratio of maximum to minimum of the volume of the second fluid chamber (72). In other words, when employing the scroll type fluid machine (10) of the ninth invention as a compressor, the compression ratio in the first fluid chamber (71) is so set as to have a different value from that of the compression ratio in the second fluid chamber (72). On the other hand, when employing the scroll type fluid machine (10) of the ninth invention as an expander, the expansion ratio in the first fluid chamber (71) is so set as to have a differ value from that of the expansion ratio in the second fluid chamber (72).

In the tenth invention, the ratio of maximum to minimum of the volume of the first fluid chamber (71) agrees with the ratio of maximum to minimum of the volume of the second fluid chamber (72). In other words, when employing the scroll type fluid machine (10) of the tenth invention as a compressor, the compression ratio in the first fluid chamber (71) is so set as to have the same value as that of the compression ratio in the second fluid chamber (72). On the other hand, when employing the scroll type fluid machine (10) of the tenth invention as an expander, the expansion ratio in the first fluid chamber (71) is so set as to have the same value as that of the expansion ratio in the second fluid chamber (72).

In the eleventh invention, the scroll type fluid machine (10) provides so-called two stage compression. For example, when introducing fluid into the first fluid chamber (71) prior to the second fluid chamber (72), the fluid compressed in the first fluid chamber (71) is drawn into the second fluid chamber (72) for further compression. On the other hand, when introducing fluid into the second fluid chamber (72) prior to the first fluid chamber (71), the fluid compressed in the second fluid chamber (72) is drawn into the first fluid chamber (71) for further compression.

Effects

In the present invention, the engaging part (64) is provided in the back surface of the first flat-plate part (51) constituting the orbiting scroll (50). The engaging part (64) is brought into engagement with the rotating shaft (20). In addition, in the present invention, the first fluid chamber (71) is formed by engagement of the first movable-side wrap (53) with the first stationary-side wrap (42). On the other hand, the second movable-side wrap (54) is disposed on the front surface side of the second flat-plate part (52) provided in the orbiting scroll (50), and the second fluid chamber (72) is formed by engagement of the second movable-side wrap (54) with the second stationary-side wrap (47).

Therefore, in accordance with the present invention, even in the scroll type fluid machine (10) having the movable-side wraps (53, 54) and the stationary-side wraps (42, 47) arranged in two sets and brought into engagement with each other, it is possible to dispose the first movable-side wrap (53) in the center of the front surface of the first flat-plate part (51), as in a general scroll type fluid machine having movable- and stationary-side wraps arranged in only one set. And, the innermost diameter of the first and second spiral-shaped movable-side wraps (53, 54) on the spiral starting side can be designed smaller in comparison with employing a configuration in which both surfaces of a single flat-plate part are provided with respective wraps, thereby making it possible to reduce the minimum volume of the first and second fluid chambers (71, 72).

Therefore, in accordance with the present invention, even when a certain degree of compression ratio or expansion ratio is secured, it becomes possible to reduce the outermost diameter of the first and second movable-side wraps (53, 54) on the spiral ending side, thereby making it possible to accomplish downsizing of the orbiting scroll (50). As a result, the scroll type fluid machine (10) is decreased in size.

In the second invention, the second flat-plate part (52) which divides the first fluid chamber (71) into compartments together with the first flat-plate part (51), and the third flat-plate part (49) which divides the second fluid chamber (72) into compartments together with the second flat-plate part (52) are provided in the orbiting scroll (50). The inner pressure of the first fluid chamber (71) acts on the first and second flat-plate parts (51, 52). The force acting on the first flat-plate part (51) and the force acting on the second flat-plate part (52) are at the same magnitude but are applied in opposite directions. Likewise, the inner pressure of the second fluid chamber (72) acts on the second and third flat-plate parts (52, 49). The force acting on the second flat-plate part (52) and the force acting on the third flat-plate part (49) are at the same magnitude but are applied in opposite directions. Consequently, the forces exerted, respectively, on the first and second flat-plate parts (51, 52) by the fluid in the first fluid chamber (71) are offset against each other. Likewise, the forces exerted, respectively, on the second and third flat-plate parts (52, 49) by the fluid in the second fluid chamber (72) are offset against each other.

Therefore, in accordance with the second invention, the force that the orbiting scroll (50) receives from the fluid in each of the fluid chambers (71, 72) can be made apparently nil, thereby making it possible to considerably reduce axial load (i.e., thrust load) acting on the orbiting scroll (50). As a result, the frictional loss during the orbital motion of the orbiting scroll (50) is considerably reduced, thereby making it possible to improve the efficiency of the scroll type fluid machine (10).

In the third invention, the first movable-side wrap (53) is formed integrally with the first flat-plate part (51) which has, at its back surface, the engaging part (64). In other words, the result of integral formation of the first flat-plate part (51) and the first movable-side wrap (53) is almost identical in shape with an orbiting scroll of a general scroll type fluid machine provided with movable- and stationary-side wraps arranged in only one set. Consequently, when manufacturing the first flat-plate part (51) and the first movable-side wrap (53) which are integrally formed with each other, it is possible to utilize machines and methods designed for processing orbiting scrolls of general scroll type fluid machines. Therefore, in accordance with the present invention, the rise in costs for processing the first flat-plate part (51) and the first movable-side wrap (53) is avoided and as a result the rise in costs for manufacturing the scroll type fluid machine (10) is suppressed.

In the fourth invention, the first movable-side wrap (53) is formed integrally on the front surface side of the first flat-plate part (51) while on the other hand the second movable-side wrap (54) is formed integrally on the front surface side of the second flat-plate part (52). Accordingly, in comparison with the above-described conventional scroll type fluid machine in which both surfaces of a single flat-plate part are provided with respective movable-side wraps, the processing step of the orbiting scroll (50) is more simplified, thereby making it possible to cut down the manufacturing costs of the scroll type fluid machine (10).

In accordance with the fifth and sixth inventions, fluid is expanded in one of the fluid chambers (71, 72) and the internal energy of the fluid is recovered as rotational power. Further, the recovered power is utilized to compress liquid in the other of the fluid chambers (71, 72). As the result of this, in accordance with these inventions, the amount of power to be supplied from the outside in compressing fluid in the scroll type fluid machine (10) is reduced, thereby making it possible to improve the efficiency of the scroll type fluid machine (10).

In the seventh invention, the third flat-plate part (49) is provided with the plural introduction openings (66, 68, 69) and each of introduction openings (66, 68, 69) is placed in the open or closed state by the opening/closing mechanism (85). Consequently, the volume of the second fluid chamber (72) at the point of time that fluid is introduced through the introduction openings (66, 68, 69) can be varied. In other words, the substantial minimum volume of the second fluid chamber (72) can be varied. Therefore, in accordance with the seventh invention, it is possible to make the displacement volume of the second fluid chamber (72) variable, thereby making it possible to improve the usability of the scroll type fluid machine (10).

In the eighth, ninth, and tenth inventions, fluid compression or fluid expansion takes place in both the first and second fluid chambers (71, 72). This makes it possible to make adjustments to the volume of the scroll type fluid machine (10) by switching the fluid chambers (71, 72) into which fluid is introduced. Besides, for example, it becomes possible to provide two-stage compression so that fluid compressed in one fluid chamber is further compressed in the other fluid chamber, thereby making it possible to extend the application range of the scroll type fluid machine (10).

In the eleventh invention, it is arranged such that two-stage compression is performed in the scroll type fluid machine (10). Therefore, in accordance with the eleventh invention, the orbiting scroll (50) is downsized and the total compression ratio of the scroll type fluid machine (10) can be set to greater values by two-stage compression.

BEST MODE FOR CARRYING OUT INVENTION

Hereinafter, embodiments of the present invention are described in detail with reference to the drawings. Each of the following embodiments shows a scroll type fluid machine (10) which is linked to a refrigerant circuit (90) of a refrigeration apparatus.

Embodiment 1 of Invention

A first embodiment of the present invention is described below.

Figure 1:
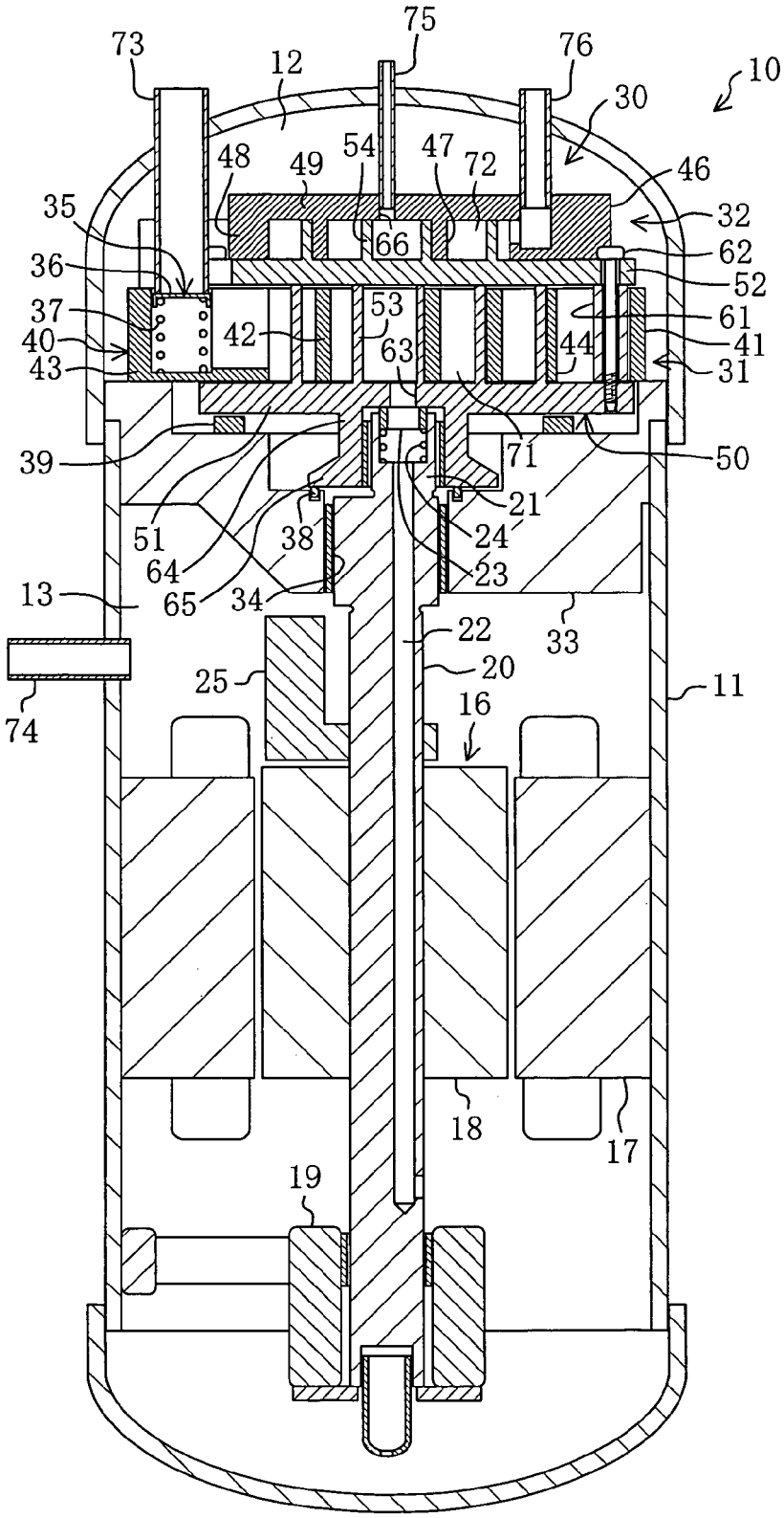
FIG. 1 is a schematic cross sectional view showing the entire arrangement of a scroll type fluid machine of a first embodiment of the present invention.

As shown in FIG. 1, the scroll type fluid machine (10) has a casing (11) shaped like an oblong, cylindrical, hermetically-sealed container. Sequentially arranged from top to bottom in the inside of the casing (11) are a main mechanism (30), an electric motor (16), and a lower bearing (19). In addition, a drive shaft (20) vertically extending in the inside of the casing (11) is provided as a rotating shaft.

The inside of the casing (11) is divided into up and down sections by a housing (33) of the main mechanism (30). More specifically, in the inside of the casing (11), a space defined above the housing (33) serves as a low-pressure chamber (12) while, on the other hand, a space defined below the housing (33) serves as a high-pressure chamber (13).

The high-pressure chamber (13) contains therein the electric motor (16) and the lower bearing (19). The electric motor (16) has a stator (17) and a rotor (18). The stator (17) is firmly attached to the main body of the casing (11). On the other hand, the rotator (18) is firmly attached to a vertically central part of the drive shaft (20). The lower bearing (19) is firmly attached to the main body of the casing (11). The lower bearing (19) rotatably supports the lower end of the drive shaft (20).

The casing (11) is provided with a tube-like discharge port (74). One end of the discharge port (74) opens to a space at a level above the electric motor (16) in the high-pressure chamber (13).

A main bearing (34) is formed in the housing (33) of the main mechanism (30), such that it vertically passes through the housing (33). The drive shaft (20) is inserted through the main bearing (34). The drive shaft (20) is rotatably supported by the main bearing (34). An upper end portion of the drive shaft (20) projecting above the level of the housing (33) forms an eccentric part (21). The eccentric part (21) is eccentric relative to the central axis of the drive shaft (20).

Attached to a part of the drive shaft (20) situated between the housing (33) and the stator (17) is a balance weight (25). An oil feeding path (not shown) is formed in the drive shaft (20). Refrigeration oil collected on the bottom of the housing (33) is pumped up from the lower end of the drive shaft (20) by action of a centrifugal pump. Then, the pumped-up refrigeration oil is supplied, through the oil feeding path, to each part. Furthermore, a discharge path (22) is formed in the drive shaft (20). The discharge path (22) will be described later.

Figure 2:
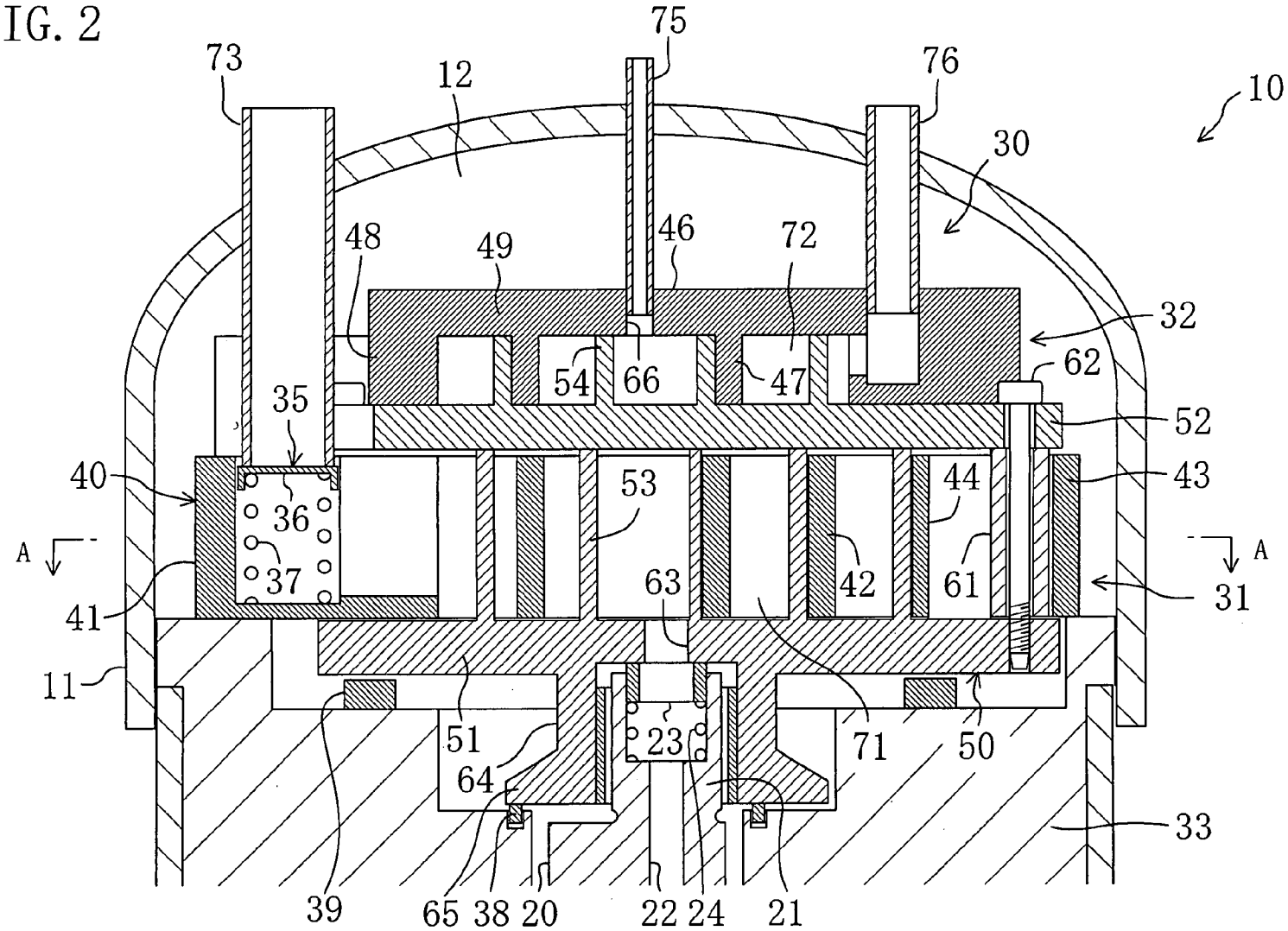
FIG. 2 is an enlarged cross sectional view showing a major part of the scroll type fluid machine of the first embodiment.

As shown in FIG. 2, the low-pressure chamber (12) contains therein stationary and orbiting scrolls (40, 50) of the main mechanism (30). Formed in the main mechanism (30) are a first volume variation part (31) which constitutes a compressor and a second volume variation part (32) which constitutes an expander. The low-pressure chamber (12) further contains therein an Oldham ring (39).

The fixed scroll (40) is made up of a first stationary-side member (41) and a second stationary-side member (46). The first and second stationary-side members (41, 46) together forming the fixed scroll (40) are firmly attached to the housing (33).

Figure 3:
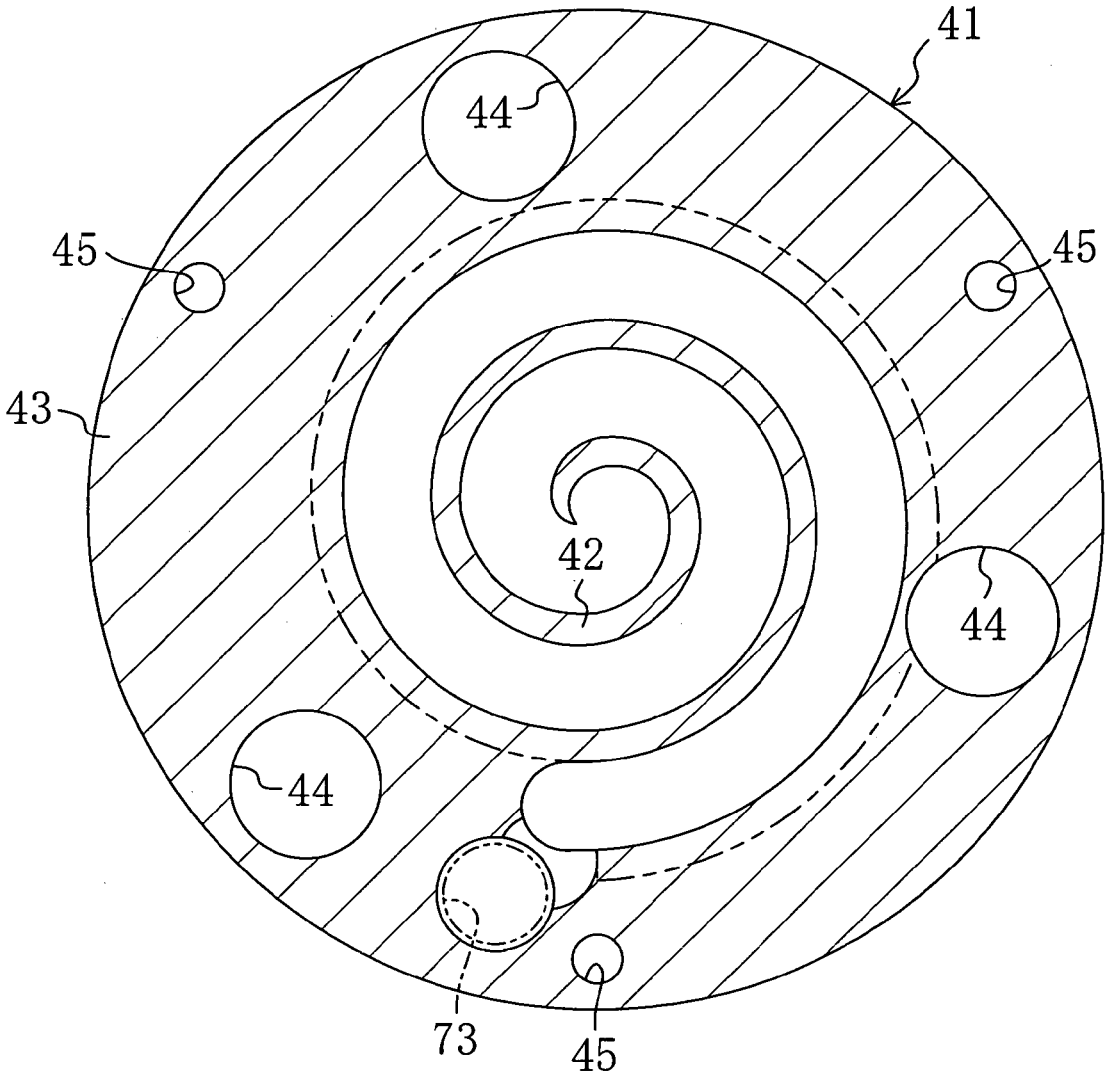
FIG. 3 is a cross sectional view showing a first stationary-side member of a fixed scroll of the first embodiment.

As also shown in FIG. 3, the first stationary-side member (41) has a first stationary-side wrap (42) and a first outer peripheral part (43). FIG. 3 is an illustration showing only the first stationary-side member (41) in a cross section taken along the line A—A of FIG. 2.

The first stationary-side wrap (42) is shaped like a spiral wall the height of which is constant. On the other hand, the first outer peripheral part (43) is shaped like a thick ring encompassing the first stationary-side wrap (42). The first outer peripheral part (43) is formed integrally with the first stationary-side wrap (42). In other words, in the first stationary-side member (41), the first stationary-side wrap (42) projects, in the form of a cantilever beam, from the inner peripheral surface of the first outer peripheral part (43). In addition, three insertion holes (44) and three bolt holes (45) are formed through the first outer peripheral part (43). The first stationary-side member (41) is firmly fastened, by bolts slid into the bolt holes (45), to the housing (33).

One end of a tube-like suction port (73) is inserted into the first stationary-side member (41) (see FIG. 2). The suction port (73) is provided, such that it passes through an upper end portion of the casing (11). A suction check valve (35) is mounted at the bottom of the suction port (73) in the first stationary-side member (41). The suction check valve (35) is made up of a valve body (36) and a coil spring (37). The valve body (36) is shaped like a cap. The valve body (36) is disposed, such that it closes the lower end of the suction port (73). In addition, the valve body (36) is pressed against the lower end of the suction port (73) by the coil spring (37).

As shown in FIG. 2, the second stationary-side member (46) has a second stationary-side wrap (47), a second outer peripheral part (48), and a third flat-plate part (49). The second stationary-side member (46), when viewed as a whole, is shaped like a disc smaller in diameter and thickness than the first stationary-side member (41). The third flat-plate part (49) is shaped like a disc and is disposed at the upper side of the second stationary-side member (46). The second outer peripheral part (48) is formed integrally with the third flat-plate part (49) and extends downwardly from the third flat-plate part (49). The second outer peripheral part (48) is shaped like a thick ring having the same outer diameter as that of the third flat-plate part (49).

In the second stationary-side member (46), the second stationary-side wrap (47) is disposed inside the second outer peripheral part (48). The second stationary-side wrap (47) is formed integrally with the third flat-plate part (49). The second stationary-side wrap (47) is shaped like a spiral wall the height of which is shorter than that of the first stationary-side wrap (42). The second stationary-side wrap (47) extends downwardly from the lower surface of the third flat-plate part (49). In addition, the second stationary-side wrap (47) and the first stationary-side wrap (42) spiral in opposite directions. Stated another way, the first stationary-side wrap (42) is shaped like a right-handed spiral wall (see FIG. 3) while, on the other hand, the second stationary-side wrap (47) is shaped like a left-handed spiral wall.

One end of an outflow port (76) is inserted into the second stationary-side member (46). The outflow port (76) is formed, such that it passes through an upper end part of the casing (11). In addition, centrally formed in the third flat-plate part (49) of the second stationary-side member (46) is an inflow opening (66). The inflow opening (66) opens in the vicinity of an end of the second stationary-side wrap (47) on its spiral starting side and passes through the third flat-plate part (49). One end of a tube-like inflow port (75) is inserted into the inflow opening (66). The inflow port (75) is formed, such that it passes through an upper end part of the casing (11).

The orbiting scroll (50) has a first flat-plate part (51), a first movable-side wrap (53), a second flat-plate part (52), a second movable-side wrap (54), and support rod members (61). The first movable-side wrap (53) is formed integrally with the first flat-plate part (51). On the other hand, the second movable-side wrap (54) is formed integrally with the second flat-plate part (52). In the orbiting scroll (50), the three support rod members (61) are so mounted as to stand on the upper surface of the first flat-plate part (51) formed integrally with the first movable-side wrap (53), and the second flat-plate part (52) formed integrally with the second movable-side wrap (54) is placed on the support rod members (61). And, in the orbiting scroll (50), the first flat-plate part (51), the support rod members (61), and the second flat-plate part (52) which are placed one upon the other are fastened together by bolts (62).

Figure 4:
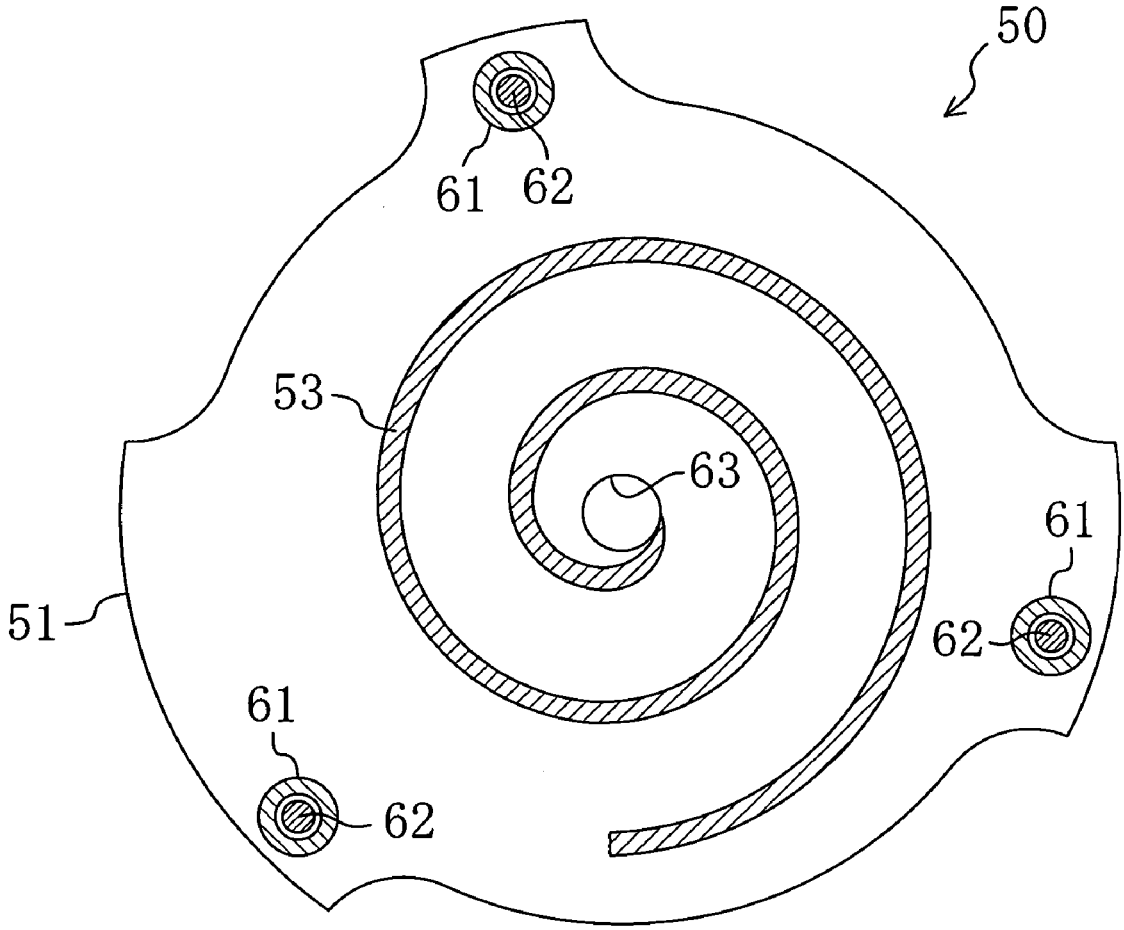
FIG. 4 is a cross sectional view showing an orbiting scroll of the first embodiment.
Figure 5:
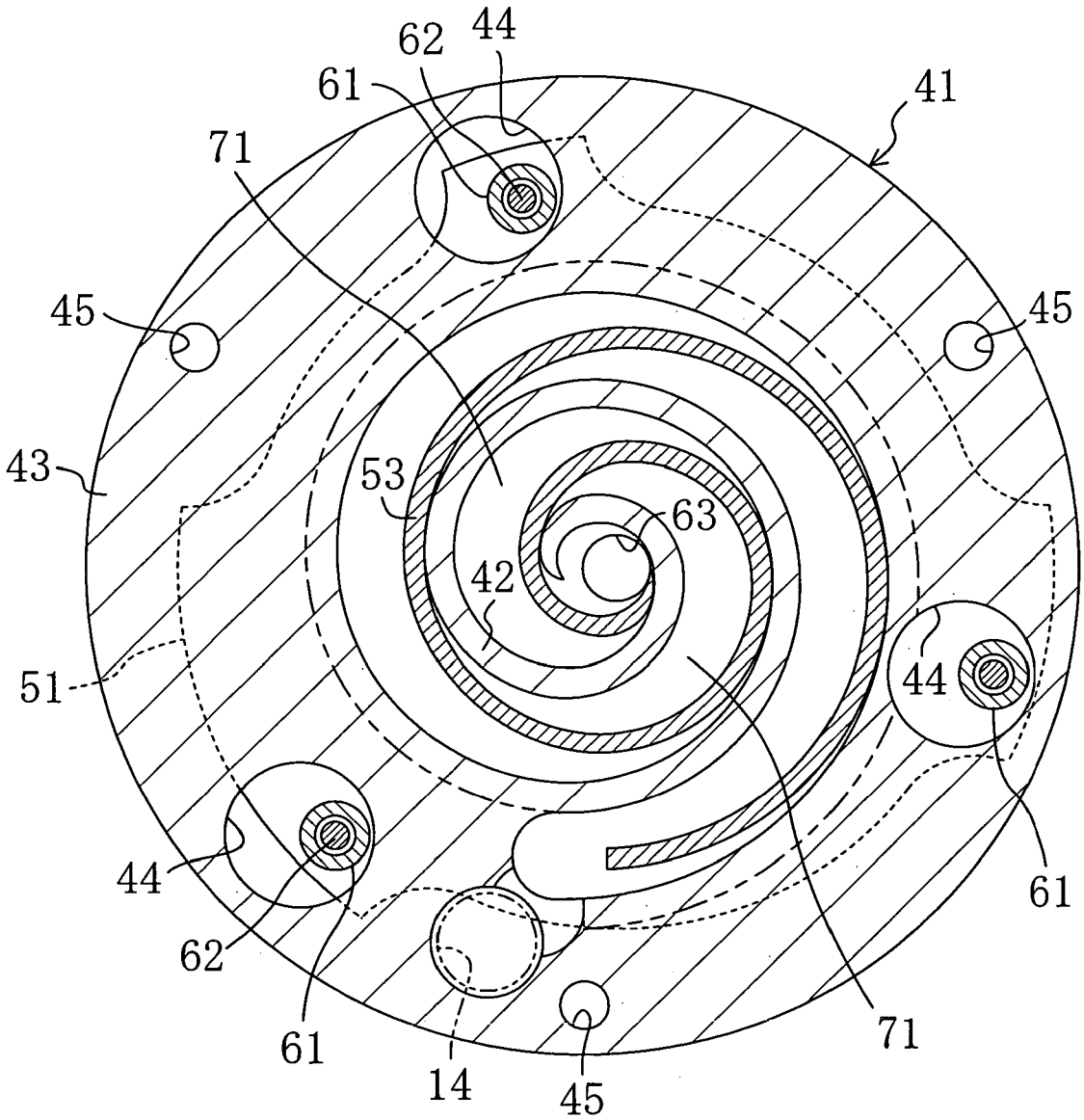
FIG. 5 is a top plan view showing the first stationary-side member and the orbiting scroll of the first embodiment.

The first flat-plate part (51) and the first movable-side wrap (53) are described by making reference to FIGS. 2, 4, and 5. FIG. 4 is an illustration showing only the orbiting scroll (50) in a cross section taken along the line A—A of FIG. 2. And, FIG. 5 is an illustration showing the first stationary-side member (41) and the orbiting scroll (50) in a cross section taken along the line A—A of FIG. 2.

As shown in FIG. 4, the first flat-plate part (51) is shaped like a generally circular flat plate. The front surface (upper surface in FIG. 2) of the first flat-plate part (51) comes into sliding contact with the lower end surface of the first stationary-side wrap (42). The first flat-plate part (51) has three radially projecting projections. The three support rod members (61) are so mounted as to stand on the three projections, respectively. Each support rod member (61) is a somewhat thick, tube-like member and is formed as a different body from the first flat-plate part (51).

The first movable-side wrap (53) is shaped like a spiral wall the height of which is constant. The first movable-side wrap (53) is mounted, in a standing manner, on the front surface side (upper surface side in FIG. 2) of the first flat surface part. The first movable-side wrap (53) engages the first stationary-side wrap (42) of the first stationary-side member (41) (see FIG. 5). And, the side surface of the first movable-side wrap (53) comes into sliding contact with the side surface of the first stationary-side wrap (42).

As shown in FIG. 2, the second flat-plate part (52) is shaped like a flat plate approximately identical in shape with the first flat-plate part (51). The back surface (lower surface in FIG. 2) of the second flat-plate part (52) comes into sliding contact with the upper end surface of the first stationary-side wrap (42) while, on the other hand, the front surface (upper surface in FIG. 2) thereof comes into sliding contact with the lower end surface of the second stationary-side wrap (47).

The second movable-side wrap (54) is mounted, in a standing manner, on the front surface side (upper surface side in FIG. 2) of the second flat-plate part (52). The second movable-side wrap (54) and the first movable-side wrap (53) spiral in opposite directions. In other words, the first movable-side wrap (53) is shaped like a right-handed spiral wall (see FIG. 4) while on the other hand the second movable-side wrap (54) is shaped like a left-handed spiral wall.

In the main mechanism (30), the first stationary-side wrap (42), the first movable-side wrap (53), the first flat-plate part (51), and the second flat-plate part (52) together form a plurality of first fluid chambers (71). And, the first flat-plate part (51), the second flat-plate part (52) and the first movable-side wrap (53) in the orbiting scroll (50), and the first stationary-side member (41) in the fixed scroll (40) having the first stationary-side wrap (42) together form the first volume variation part (31).

In addition, in the main mechanism (30), the second stationary-side wrap (47), the second movable-side wrap (54), the second flat-plate part (52), and the third flat-plate part (49) together form a plurality of second fluid chambers (72). And, the second flat-plate part (52) and the second movable-side wrap (54) in the orbiting scroll (50), and the second stationary-side member (46) in the fixed scroll (40) having the third flat-plate part (49) and the second stationary-side wrap (47) together form the second volume variation part (32).

Centrally formed in the first flat-plate part (51) of the orbiting scroll (50) is a discharge opening (63). The discharge opening (63) opens in the vicinity of an end of the first movable-side wrap (53) on its spiral starting side (see FIG. 4) and passes through the first flat-plate part (51). In addition, a bearing part (64) is formed in the first flat-plate part (51). The bearing part (64) is formed into an approximately cylindrical shape. The bearing part (64) is formed, in a projecting manner, on the back surface side (lower surface side in FIG. 2) of the first flat-plate part (51). Furthermore, a collar part (65) shaped like a collar is formed at the lower end of the bearing part (64).

A seal ring (38) is mounted between the lower surface of the collar part (65) of the bearing part (64) and the housing (33). A supply of high-pressure refrigeration oil is provided, through the oil feeding path of the drive shaft (20), to the inside of the seal ring (38). When high-pressure refrigeration oil is fed to the inside of the seal ring (38), oil pressure acts on the bottom surface of the collar part (65), thereby pushing the orbiting scroll (50) upwardly.

The eccentric part (21) of the drive shaft (20) is inserted into the bearing part (64) of the first flat-plate part (51). The entrance end of the discharge path (22) opens at the upper end surface of the eccentric part (21). The discharge path (22) is formed, such that its portion in the vicinity of the entrance end has a diameter slightly greater than that of the other, and a tubular seal (23) and a coil spring (24) are disposed within the discharge path (22). The tubular seal (23) is shaped like a pipe whose inside diameter is slightly greater than the diameter of the discharge opening (63). The tubular seal (23) is pressed against the back surface of the first flat-plate part (51) by the coil spring (24). In addition, the exit end of the discharge path (22) opens at a portion of the side surface of the drive shaft (20) situated between the stator (17) and the lower bearing (19) (see FIG. 1).

An Oldham ring (39) is inserted between the first flat-plate part (51) and the housing (33). The Oldham ring (39) has a pair of keys which engage the first flat-plate part (51) and another pair of keys which engage the housing (33). And, the Oldham ring (39) forms a mechanism for preventing the orbiting scroll (50) from rotating. Here, the pressure inside the seal ring (38) is high and the pressure outside the seal ring (38) is low (suction pressure). Consequently, refrigeration oil flows out from the inside to outside of the seal ring (38). The refrigeration oil flowing out from the seal ring (38) is supplied to the key parts of the Oldham ring (39).

Figure 6:
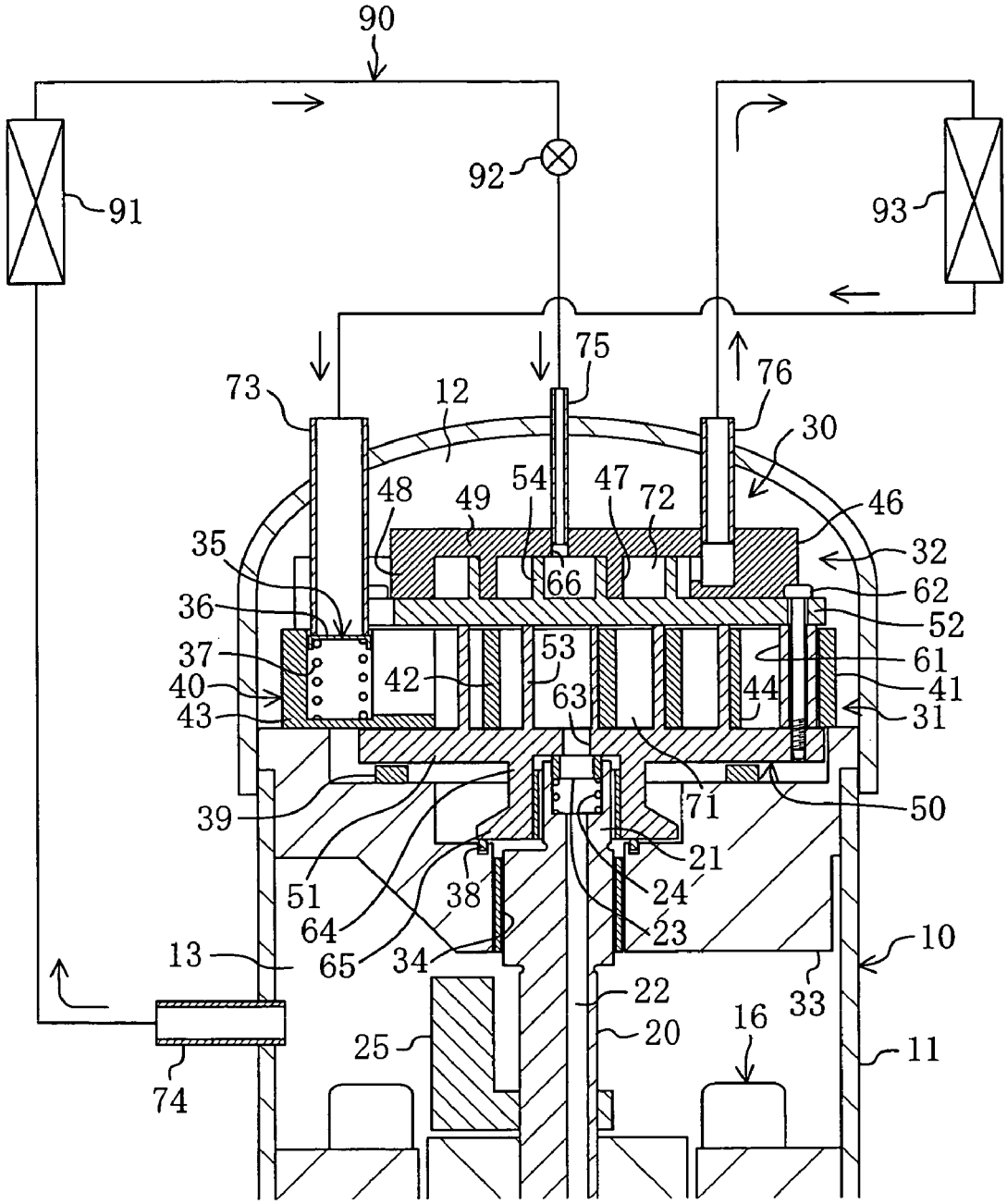
FIG. 6 is a schematic constructional diagram of a refrigerant circuit provided with a scroll type fluid machine of the first embodiment.

As shown in FIG. 6, the scroll type fluid machine (10) of the present embodiment is disposed in a refrigerant circuit (90) of a refrigeration apparatus. In the refrigerant circuit (90), refrigerant is circulated and as a result a vapor compression refrigeration cycle is performed.

In the scroll type fluid machine (10) in the refrigerant circuit (90), the discharge port (74) is linked to one end of a condenser (91) and the inflow port (75) is linked, through an expansion valve (92), to the other end of the condenser (91). In addition, in the scroll type fluid machine (10), the outflow port (76) is linked to one end of an evaporator (93) and the suction port (73) is linked to the other end of the evaporator (93). The first volume variation part (31) of the scroll type fluid machine (10) constitutes a compressor which compresses refrigerant in the refrigerant circuit (90). On the other hand, the second volume variation part (32) operates as an expander which recovers power by expanding refrigerant in the refrigerant circuit (90), and forms, together with the expansion valve (92), an expansion mechanism.

Running Operation

In the scroll type fluid machine (10), rotational power generated by the electric motor (16) is transferred to the orbiting scroll (50) by the drive shaft (20). The orbiting scroll (50) which engages the eccentric part (21) of the drive shaft (20) is guided by the Oldham ring (39) and makes only orbital motion without rotation.

With the orbital motion of the orbiting scroll (50), low-pressure refrigerant evaporated in the evaporator (93) is drawn into the suction port (73). The low-pressure refrigerant depresses the valve body (36) of the suction check valve (35) and flows into the first fluid chamber (71). As the first movable-side wrap (53) of the orbiting scroll (50) moves, the volume of the first fluid chamber (71) decreases. As a result, the refrigerant within the first fluid chamber (71) is compressed. The compressed refrigerant passes through the discharge opening (63) and then flows into the discharge path (22) from the first fluid chamber (71). Thereafter, the high-pressure refrigerant flows into the high-pressure chamber (13) from the discharge path (22), passes through the discharge port (74), and leaves the casing (11).

The high-pressure refrigerant discharged out through the discharge port (74) is delivered to the condenser (91) where it is condensed. The refrigerant condensed in the condenser (91) is somewhat reduced in pressure during passage through the expansion valve (92) and then flows into the inflow port (75). It may be arranged such that, depending on the operational status of the refrigeration apparatus, the expansion valve (92) is set in the fully open state so that refrigerant condensed in the condenser (91) is fed into the inflow port (75), almost without any pressure reduction.

The inflow refrigerant into the inflow port (75) is introduced to the second fluid chamber (72) where it is expanded. By the refrigerant being expanded within the second fluid chamber (72), the second movable-side wrap (54) moves, and as the second movable-side wrap (54) moves, the volume of the second fluid chamber (72) increases. In other words, part of the internal energy of the refrigerant introduced into the second fluid chamber (72) is converted into power for moving the second movable-side wrap (54). And, the orbiting scroll (50) is activated by both drive power generated by the electric motor (16) and power recovered from the refrigerant in the second volume variation part (32).

Effects of Embodiment 1

As described above, in the present embodiment, the bearing part (64) is provided in the back surface of the first flat-plate part (51) constituting the orbiting scroll (50), and the drive shaft (20) is brought into engagement with the orbiting scroll (50) by inserting the end of the drive shaft (20) into the bearing part (64). In addition, in the present embodiment, the first fluid chamber (71) is formed by engagement of the first movable-side wrap (53) with the first stationary-side wrap (42). On the other hand, the second movable-side wrap (54) is arranged on the front surface side of the second flat-plate part (52) provided in the orbiting scroll (50), wherein the second fluid chamber (72) is formed by engagement of the second movable-side wrap (54) with the second stationary-side wrap (47).

Therefore, in accordance with the present embodiment, even in the scroll type fluid machine (10) having the movable-side wraps (53, 54) and the stationary-side wraps (42, 47) arranged in two sets and brought into engagement with each other, it is possible to dispose the first movable-side wrap (53) in the center of the front surface of the first flat-plate part (51), as in a general scroll type fluid machine having movable- and stationary-side wraps arranged in only one set. And, the innermost diameter of the first and second spiral-shaped movable-side wraps (53, 54) on the spiral starting side can be designed smaller in comparison with employing a configuration in which both surfaces of a single flat-plate part are provided with respective wraps, thereby making it possible to reduce the minimum volume of the first and second fluid chambers (71, 72).

Therefore, in accordance with the present embodiment, even when a certain degree of compression ratio or expansion ratio is secured, it becomes possible to reduce the outermost diameter of the first and second movable-side wraps (53, 54) on the spiral ending side, thereby making it possible to accomplish downsizing of the orbiting scroll (50). As a result, the scroll type fluid machine (10) is decreased in size.

In addition, in the present embodiment, the first movable-side wrap (53) is formed integrally with the first flat-plate part (51) which has, at its back surface, the projectingly-formed engaging part (64). In other words, the result of integral formation of the first flat-plate part (51) and the first movable-side wrap (53) is almost identical in shape with an orbiting scroll of a general scroll type fluid machine provided with movable- and stationary-side wraps arranged in only one set. Consequently, when manufacturing the first flat-plate part (51) and the first movable-side wrap (53) which are integrally formed with each other, it is possible to utilize machines and methods designed for processing orbiting scrolls of general scroll type fluid machines. Therefore, in accordance with the present embodiment, the rise in costs for processing the first flat-plate part (51) and the first movable-side wrap (53) is avoided and as a result the rise in costs for manufacturing the scroll type fluid machine (10) is suppressed.

In addition, in the present embodiment, the first movable-side wrap (53) is formed integrally on the front surface side of the first flat-plate part (51) while on the other hand the second movable-side wrap (54) is formed integrally on the front surface side of the second flat-plate part (52). Accordingly, in comparison with the above-described conventional scroll type fluid machine in which both surfaces of a single flat-plate part are provided with respective movable-side wraps, the processing step of the orbiting scroll (50) is more simplified, thereby making it possible to cut down the manufacturing costs of the scroll type fluid machine (10).

Additionally, in accordance with the present embodiment, fluid is expanded in one of the fluid chambers (71, 72) and the internal energy of the fluid is recovered as rotational power. Further, the recovered power is utilized to compress liquid in the other of the fluid chambers (71, 72). As the result of this, the amount of power to be supplied from the outside in compressing fluid in the scroll type fluid machine (10) is reduced, thereby making it possible to improve the efficiency of the scroll type fluid machine (10).

Besides, in the present embodiment, the first volume variation part (31) constitutes a compressor, and the second volume variation part (31) defined above the first volume variation part (31) constitutes an expander. Therefore, in accordance with the present embodiment, lubrication between the Oldham ring (39), and the housing (33) and the first flat-plate part (51) is provided without fail, thereby making it possible to secure the reliability of the scroll type fluid machine (10).

The above is explained. Suppose that in the scroll type fluid machine (10) of the present embodiment the first volume variation part (31) is used as an expander. In this case, liquid refrigerant introduced into the first fluid chamber (71) expands and changes state into a gas-liquid two-phase state. The refrigerant in the gas-liquid two-phase state is discharged out of the first fluid chamber (71). On the other hand, the scroll type fluid machine (10) is configured such that the refrigerant discharged out of the first fluid chamber (71) flows also into the low-pressure chamber (12) (see FIG. 2). Consequently, the liquid refrigerant discharged out of the first fluid chamber (71) enters areas in the vicinity of the Oldham ring (39), thereby producing the possibility that poor lubrication occurs between the Oldham ring (39) and the first flat-plate part (51).

On the contrary, in the present embodiment, the second volume variation part (32) is used as an expander. And, both the inflow port (75) and the outflow port (76) are linked to the second stationary-side member (46), and it is configured such that refrigerant passing through the second fluid chamber (72) is prevented from flowing into the low-pressure chamber (12). In addition, refrigerant which is drawn into the first fluid chamber (71) of the first volume variation part (31) forming a compressor is perfectly in the form of gas refrigerant in normal operation conditions. In other words, only gas refrigerant is allowed to flow into the vicinity of the Oldham ring (39). This secures formation of an oil film between the Oldham ring (39) and the first flat-plate part (51), and as a result adequate lubrication is provided.

In addition, although part of refrigeration oil supplied to the vicinity of the Oldham ring (39) is mixed into refrigerant which is drawn into the first fluid chamber (71), it is expelled out from the first fluid chamber (71), together with discharge gas. The refrigeration oil leaving the first fluid chamber (71) exists in the form of oil drops not in liquid refrigerant but in gas refrigerant. This facilitates separation of discharge gas and refrigeration oil, and the storage amount of refrigeration oil within the casing (11) is secured.

In the way as described above, if the second volume variation part (32) is used as an expander, lubrication between the Oldham ring (39), and the housing (33) and the first flat-plate part (51) is provided without fail even when employing the same oil feeding method as employed in general scroll type fluid machinery. Therefore, in accordance with the present embodiment, the reliability of the scroll type fluid machine (10) is satisfactorily secured.

Embodiment 2 of Invention

A second embodiment of the present invention is described. The second embodiment is similar to the first embodiment, with the exception of modifications in the configuration of the main mechanism (30). Here, the difference between the first and second embodiments about the scroll type fluid machine (10) is described.

Figure 7:
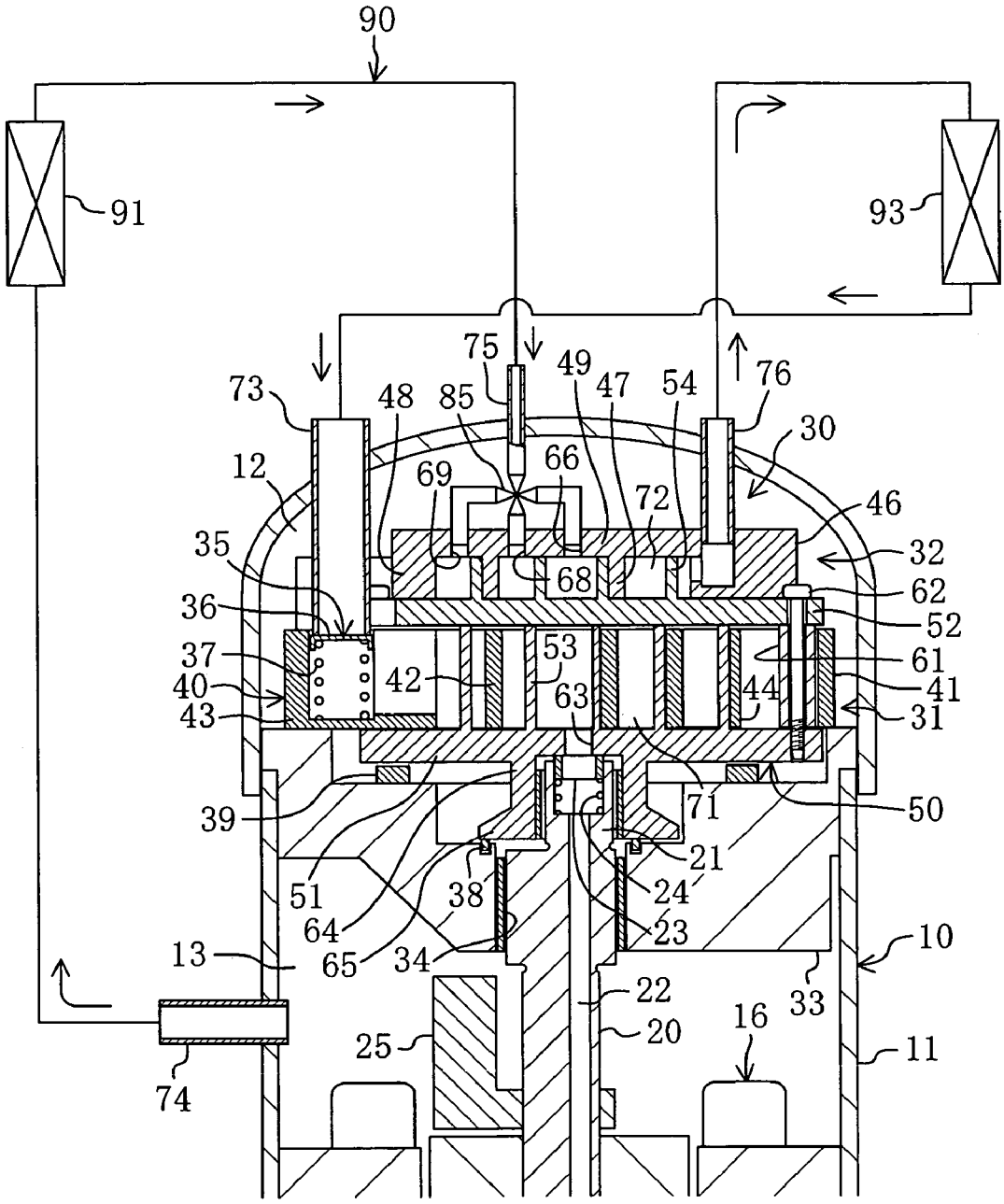
FIG. 7 is a schematic constructional diagram showing a scroll type fluid machine of a second embodiment of the present invention and a refrigerant circuit provided with the scroll type fluid machine.

As shown in FIG. 7, in the main mechanism (30) of the second embodiment, the first volume variation part (31) forms a compressor and the second volume variation part (32) forms an expander, as in the first embodiment. In the main mechanism (30) of the second embodiment, however, the expander formed by the second volume variation part (32) is variable in volume. Associated with this, the provision of the expansion valve (92) is omitted in the refrigerant circuit (90) of the second embodiment.

In the main mechanism (30), three inflow openings (66, 68, 69) as introduction openings are formed in the third flat-plate part (49) of the second stationary-side member (46). These three inflow openings (66, 68, 69) are formed at different positions relative to the radial direction of the second stationary-side wrap (47), and pass through the third flat-plate part (49).

More specifically, the first inflow opening (66) opens in the vicinity of an end of the second stationary-side wrap (47) on the spiral staring side. The second and third inflow openings (68, 69) are formed at positions respectively apart from the first inflow opening (66) in the radial direction of the second stationary-side wrap (47). The distance between the third inflow opening (69) and the first inflow opening (66) is longer than the distance between the second inflow opening (68) and the first inflow opening (66). These three inflow openings (66, 68, 69) are not necessarily aligned in a straight line.

Each of the inflow openings (66, 68, 69) opens at the lower surface of the third flat-plate part (49), and is in communication with the second fluid chamber (72). In addition, as described above, the inflow openings (66, 68, 69) are arranged at different potions relative to the radial direction of the second stationary-side wrap (47). As a result of such arrangement, the second fluid chambers (72), respectively, in communication with the inflow openings (66, 68, 69) differ from one another in volume.

The inflow port (75) of the present embodiment is divided, at its terminal end side, into three branches. Of the terminal ends of the inflow port (75), the first terminal end is inserted into the first inflow opening (66); the second terminal end is inserted into the second inflow opening (68); and the third terminal end is inserted into the third inflow opening (69). On the other hand, the leading end of the inflow port (75) is linked, through a pipe of the refrigerant circuit (90), to the condenser (91).

The inflow port (75) is provided with a four-way valve (85). The four-way valve (85) is disposed where the inflow port (75) is divided into the branches. The four-way valve (85) constitutes an opening/closing mechanism, and is operable to individually place each of the first to third inflow openings (66, 68, 69) in the open or closed state. Of the three inflow openings (66, 68, 69), one that is placed in the open state by the four-way valve (85) comes into communication with the leading end of the inflow port (75). And, refrigerant condensed in the condenser (91) flows, through the inflow opening (66, 68, 69) in the open state, into the second fluid chamber (72).

As described above, by operation of the four-way valve (85), the inflow openings (66, 68, 69) through which refrigerant passes towards the second fluid chamber (72) are changed, and the volume of the second fluid chamber (72) at the point of time when refrigerant is introduced from the condenser (91) varies. The smallest volume of the second fluid chamber (72) at the time of refrigerant introduction occurs when refrigerant is introduced through the first inflow opening (66). The second smallest volume occurs when refrigerant is introduced through the second inflow opening (68). The third smallest volume occurs when refrigerant is introduced through the third inflow opening (69). Stated another way, the containment volume of the second fluid chamber (72) in the second volume variation part (32) increases in sequence. Accordingly, the volume of the expander formed by the second volume variation part (32) increases in stages. More specifically, the smallest volume occurs when refrigerant is introduced through the first inflow opening (66). The second smallest volume occurs when refrigerant is introduced through the second inflow opening (68). The third smallest volume occurs when refrigerant is introduced through the third inflow opening (69).

When the second inflow opening (68) is placed in the open state, preferably the first inflow opening (66) is also placed in the open state at the same time. If the first inflow opening (66) is placed in the open state, this makes it possible to prevent the inner pressure of the second fluid chamber (72) located nearer to the center than the second inflow opening (68) from dropping abnormally. Likewise, when the third inflow opening (69) is placed in the open state, preferably the first and second inflow openings (66, 68) are also placed in the open state at the same time. If the first and second inflow openings (66, 68) are placed in the open state, this makes it possible to prevent the inner pressure of the second fluid chamber (72) located nearer to the center than the third inflow opening (69) from dropping abnormally.

Effects of Embodiment 2

Generally, when performing a refrigeration cycle in a refrigerant circuit to which an expander is connected, the required displacement volume of the expander varies depending on the operational status of the refrigerant cycle. Consequently, if a volume-fixed expander is provided in a refrigerant circuit, this requires provision of an expansion valve at a position upstream of the expander and provision of a pipe bypassing the expander. In other words, if the volume of the expander is excessive for the required value, the pressure of refrigerant is pre-reduced by the expansion valve and then introduced to the expander, or if the volume of the expander is too small for the required value, a part of refrigerant is made to flow into the bypass pipe. Any of these cases, however, falls into the state that sufficient power cannot be recovered from the refrigerant.

On the other hand, in the scroll type fluid machine (10) of the present embodiment, the volume of the expander formed by the second volume variation part (32) is variable. Consequently, refrigerant condensed in the condenser (91) can be introduced into the second fluid chamber (72) without compressing all of the condensed refrigerant, regardless of the operating condition of the refrigeration cycle, thereby making it possible to cut down the electric power consumption of the electric motor (16) by recovering power from the refrigerant without fail.

Variation of Embodiment 2

In the present embodiment, not only the volume of the expander formed by the second volume variation part (32) but also the volume of the compressor formed by the first volume variation part (31) may be made variable.

Examples of the configuration capable of making the first volume variation part (31) as a compressor variable in volume are as follows. It may be arranged such that in the first place the frequency of alternating electric current which is supplied to the electric motor (16) is varied by means of an inverter in order to change the rotational speed of the drive shaft (20), thereby to change the volume of the first volume variation part (31). Alternatively, it may be arranged such that a bypass passageway for directly linking together the discharge and suction ports (74, 73) of the scroll type fluid machine (10) is provided in order to make adjustments to the flow rate of refrigerant which is brought back directly to the suction port (73) from the discharge port (74) by way of the bypass passageway, thereby to change the volume of the first volume variation part (31). In addition, it may be arranged such that an expansion valve is disposed between the evaporator (93) and the suction port (73) of the scroll type fluid machine (10) in order to cause the density of refrigerant flowing into the suction port (73) to vary by adjusting the degree of opening of the expansion valve, thereby to change the volume of the first volume variation part (31).

Embodiment 3 of Invention

A third embodiment of the present invention is described. The third embodiment is similar to the first embodiment, with the exception of modifications in the configuration of the main mechanism (30). Here, the difference between the first and third embodiments about the scroll type fluid machine (10) is described.

In the main mechanism (30) of the present embodiment, the second volume variation part (32) constitutes a compressor. That is, both the first and second volume variation parts (31, 32) are compressors.

More specifically, in the main mechanism (30), the spiral direction of the second stationary-side wrap (47) is the same as the spiral direction of the first stationary-side wrap (42). Like the first stationary-side wrap (42) which is shaped like a right-handed spiral wall (see FIG. 3), the second stationary-side wrap (47) is also shaped like a right-handed spiral wall.

In addition, in the main mechanism (30), the compression ratio in the second volume variation part (32) is greater than the compression ratio in the first volume variation part (31). In other words, the ratio of maximum to minimum volume in the second fluid chamber (72) is set higher than the ratio of maximum to minimum volume in the first fluid chamber (71). Here, the compression ratio in the second volume variation part (32) is set higher than the compression ratio in the first volume variation part (31); however, the compression ratio in the second volume variation part (32) may be set smaller than the compression ratio in the first volume variation part (31) depending on the use condition of the scroll type fluid machine (10).

Figure 8:
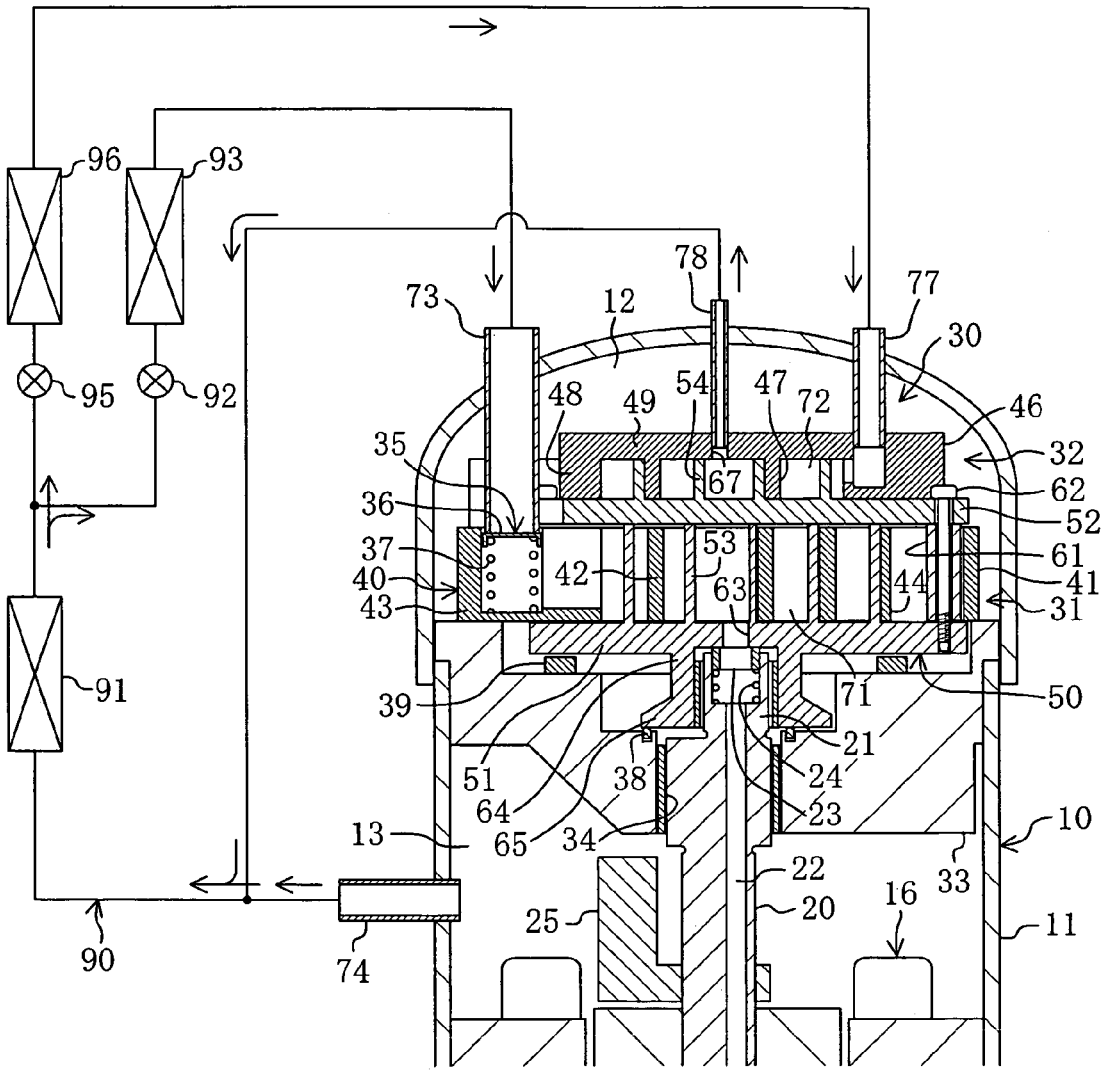
FIG. 8 is a schematic constructional diagram showing a scroll type fluid machine of a third embodiment of the present invention and a refrigerant circuit provided with the scroll type fluid machine.

As shown in FIG. 8, in the main mechanism (30), the suction port (73) of the first embodiment constitutes a first suction port (73), and the discharge port (74) of the first embodiment constitutes a first discharge port (74). In addition, in the main mechanism (30), the discharge opening (63) of the first embodiment constitutes a first discharge opening (63), and the inflow opening (66) of the first embodiment constitutes a second discharge opening (67). Furthermore, in the main mechanism (30), the outflow port (76) of the first embodiment constitutes a second suction port (77), and the inflow port (75) of the first embodiment constitutes a second discharge port (78).

The refrigerant circuit (90), in which the scroll type fluid machine (10) of the present embodiment is disposed, is provided with two expansion valves (92, 95) and two evaporators (93, 96). In the refrigerant circuit (90), the temperature at which refrigerant evaporates in the second evaporator (96) is so set as to fall below the temperature at which refrigerant evaporates in the first evaporator (93).

In the refrigerant circuit (90), the first and second discharge ports (74, 78) of the scroll type fluid machine (10) are linked to one end of the condenser (91). The other end of the condenser (91) is linked to the first and second expansion valves (92, 95). One end of the first evaporator (93) is linked to the first expansion valve (92). The other end of the first evaporator (93) is linked to the first suction port (73) of the scroll type fluid machine (10). One end of the second evaporator (96) is linked to the second expansion valve (95).

The other end of the second evaporator (96) is linked to the second suction port (77) of the scroll type fluid machine (10).

In the scroll type fluid machine (10), refrigerant compressed in the first volume variation part (31) is discharged out through the first discharge port (74) while, on the other hand, refrigerant compressed in the second volume variation part (32) is discharged out through the second discharge port (78). The pressure of the refrigerant discharged out through the first discharge port (74) and the pressure of the refrigerant discharged out through the second discharge port (78) are the same. The refrigerant discharged out through the first discharge port (74) and the refrigerant discharged out through the second discharge port (78) condense in the condenser (91). After leaving the condenser (91), the flow of the condensed refrigerant is divided into two branch flows.

One of the two refrigerant branch flows is reduced in pressure by the first expansion valve (92), evaporates in the first evaporator (93), and is drawn, through the first suction port (73), into the first fluid chamber (71) of the first volume variation part (31). Meanwhile, the other refrigerant branch flow is reduced in pressure by the second expansion valve (95), evaporates in the second evaporator (96), and is drawn, through the second suction port (77), into the second fluid chamber (72) of the second volume variation part (32). At that time, in the refrigerant circuit (90), the degree of opening of the second expansion valve (95) is set smaller than that of the first expansion valve (92), and the refrigerant evaporation pressure in the second evaporator (96) is set lower than that in the first evaporator (93).

As describe above, in accordance with the present embodiment, even in the refrigerant circuit (90) provided with the two evaporators (93, 96) which differ from each other in refrigerant evaporation temperature, refrigerant compression can be performed by the single scroll type fluid machine (10) alone, thereby making it possible to simplify the configuration of refrigeration apparatus.

Besides, in accordance with the present embodiment, even in the scroll type fluid machine (10) having the movable-side wraps (53, 54) and the stationary-side wraps (42, 47) arranged in two sets and brought into engagement with each other, it is possible to dispose the first movable-side wrap (53) in the center of the front surface of the first flat-plate part (51), as in a general scroll type fluid machine having movable- and stationary-side wraps arranged in only one set. This is the same as the aforesaid first embodiment. Therefore, in accordance with the present embodiment, the outermost diameter of the first and second movable-side wraps (53, 54) on the spiral ending side can be reduced after securing a certain degree of compression ratio, thereby making it possible to downsize the orbiting scroll (50), as in the first embodiment.

Variation of Embodiment 3

The scroll type fluid machine (10) of the present embodiment may be installed in a refrigerant circuit (90) with the following configuration.

Figure 9:
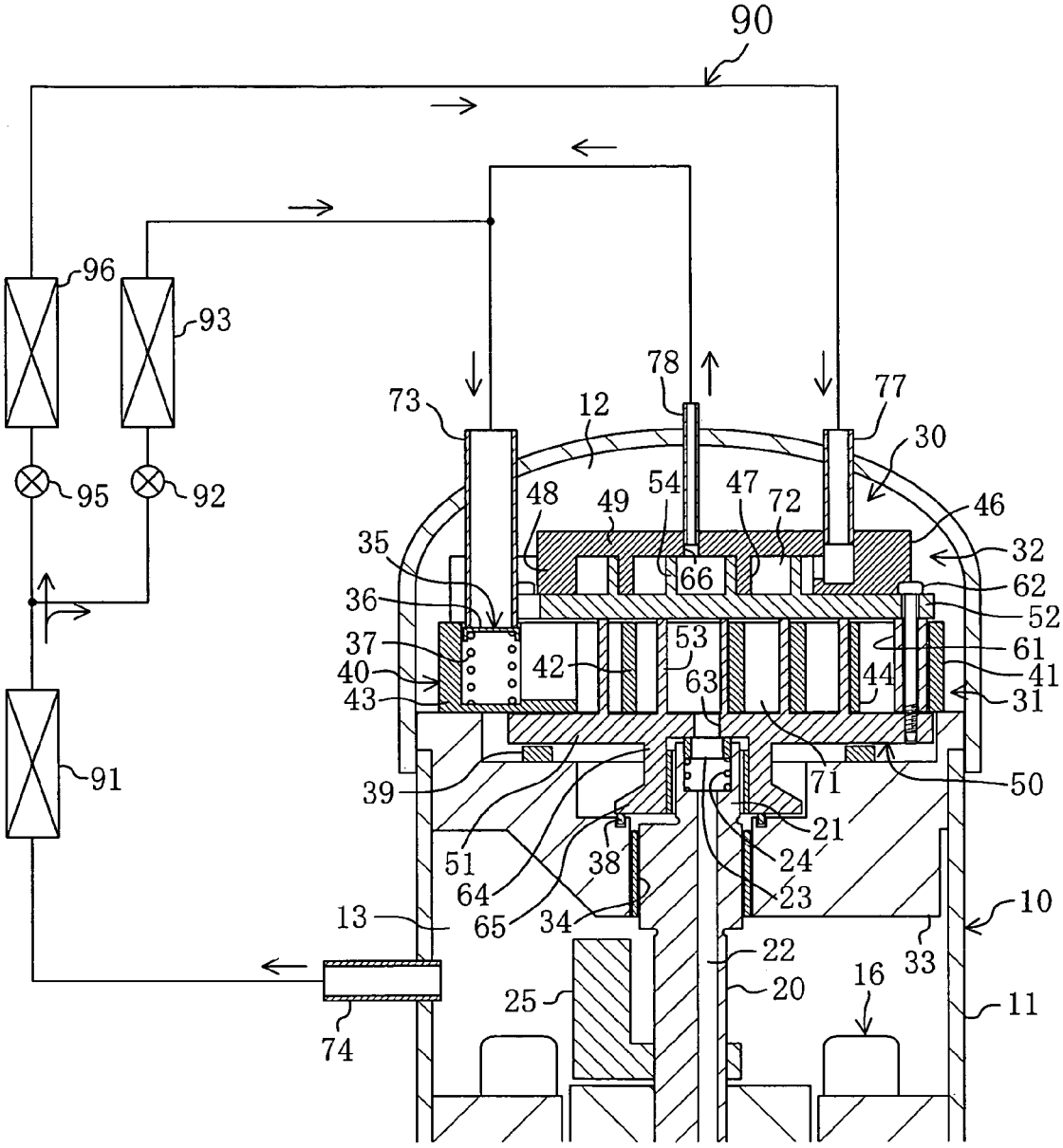
FIG. 9 is a schematic constructional diagram showing a scroll type fluid machine of a variation of the third embodiment and a refrigerant circuit provided with the scroll type fluid machine.

As shown in FIG. 9, the refrigerant circuit (90) of the present variation is also provided with two expansion valves (92, 95) and two evaporators (93, 96). And the arrangement that the refrigerant evaporation temperature in the second evaporator (96) is set lower than the refrigerant evaporation temperature in the first evaporator (93) is the same as the one as shown in FIG. 8.

In the main mechanism (30) of the present variation, the first volume variation part (31) constitutes a low-stage side compressor while on the other hand the second volume variation part (32) constitutes a high-stage side compressor. In the scroll type fluid machine (10), the first and second volume variation parts (31, 32) do not necessarily differ from each other in compression ratio, in other words it may be set such that they have the same compression ratio.

In the present variation, the first discharge port (74) of the scroll type fluid machine (10) is linked to one end of the condenser (91). The other end of the condenser (91) is divided into two branches one of which is linked to the first expansion valve (92) and the other of which is linked to the second expansion valve (95). One end of the first evaporator (93) is linked to the first expansion valve (92) while the other end thereof is linked to the first suction port (73) of the scroll type fluid machine (10). One end of the second evaporator (96) is linked to the second expansion valve (95) while the other end thereof is linked to the second suction port (77) of the scroll type fluid machine (10). In addition, the second discharge port (78) of the scroll type fluid machine (10) is linked to a suction pipe extending between the first evaporator (93) and the first suction port (73).

In the present variation, for example 90% of the total amount of refrigerant circulation in the refrigerant circuit (90) flows through the first evaporator (93) and the rest (10%) flows through the second evaporator (96).

In the scroll type fluid machine (10), refrigerant compressed in the first volume variation part (31) is discharged out through the first discharge port (74) while, on the other hand, refrigerant compressed in the second volume variation part (32) is discharged out through the second discharge port (78). The pressure of the refrigerant discharged out through the first discharge port (74) is higher than the pressure of the refrigerant discharged out through the second discharge port (78). The refrigerant discharged out through the first discharge port (74) condenses in the condenser (91). After leaving the condenser (91), the flow of the condensed refrigerant is divided into two branch flows.

One of the two refrigerant branch flows is reduced in pressure by the first expansion valve (92), evaporates in the first evaporator (93), and merges with the flow of the refrigerant discharged out through the second discharge port (78). Thereafter, the merged refrigerant is drawn, through the first suction port (73), into the first fluid chamber (71) of the first volume variation part (31). Meanwhile, the other refrigerant branch flow, divided downstream of the first condenser (91), is reduced in pressure by the second expansion valve (95), evaporates in the second evaporator (96), and is drawn, through the second suction port (77), into the second fluid chamber (72) of the second volume variation part (32). At that time, in the refrigerant circuit (90), the degree of opening of the second expansion valve (95) is set smaller than that of the first expansion valve (92), and the refrigerant evaporation pressure in the second evaporator (96) is set lower than that in the first evaporator (93). In addition, the refrigerant discharged out through the second discharge port (78) is drawn, through the first suction port (73), into the first volume variation part (31) for two-stage compression.

Here, for the case of the refrigerant circuit (90) of FIG. 8, when the difference in refrigerant evaporation temperature between the first evaporator (93) and the second evaporator (96) is substantial (for example, when the refrigerant circuit (90) is applied to a cold/frozen storage mode of operation or to an air-conditioning/frozen storage mode of operation), the required compression ratio of the second volume variation part (32) increases. Consequently, the amount of refrigerant leakage is liable to increase. In addition, the discharge temperature is liable to become excessively high.

However, the refrigerant circuit (90) of the present variation (FIG. 9) employs a two-stage compression technique so that refrigerant evaporated in the second evaporator is compressed in sequence in the second volume variation part (32) and then in the first volume variation part (31). Consequently, in the scroll type fluid machine (10) of the present variation, the amount of refrigerant leakage in the second volume variation part (32) is made less in comparison with the case where refrigerant evaporated in the second evaporator (96) is compressed in the second volume variation part (32) alone, for the second volume variation part (32) is no longer required to operate at excessively great compression ratios. In addition, the temperature of refrigerant which is discharged out of the second volume variation part (32) can be held low, and the degradation of refrigerant itself and lubrication oil due to an excessive rise in the temperature of refrigerant which is discharged out of the second volume variation part (32) is avoided.

On the other hand, when the difference in refrigerant evaporation temperature between the first evaporator (93) and the second evaporator (96) is small, the required compression ratio of the second volume variation part (32) does not increase so much. Therefore, if, as in the scroll type fluid machine (10) illustrated in FIG. 9, refrigerant undergoes two-stage compression (i.e., compression in the second volume variation part (32) and compression in the first volume variation part (31)), this worsens the problem of loss due to going through the process of discharge, respectively, in the second volume variation part (32) and in the first volume variation part (31). Accordingly, to cope with such a case, it is preferable to employ a configuration as shown in FIG. 8, in other words refrigerant evaporated in the first evaporator (93) and refrigerant evaporated in the second evaporator (96) are compressed in the first volume variation part (31) and in the second volume variation part (32), respectively.

Figure 10:
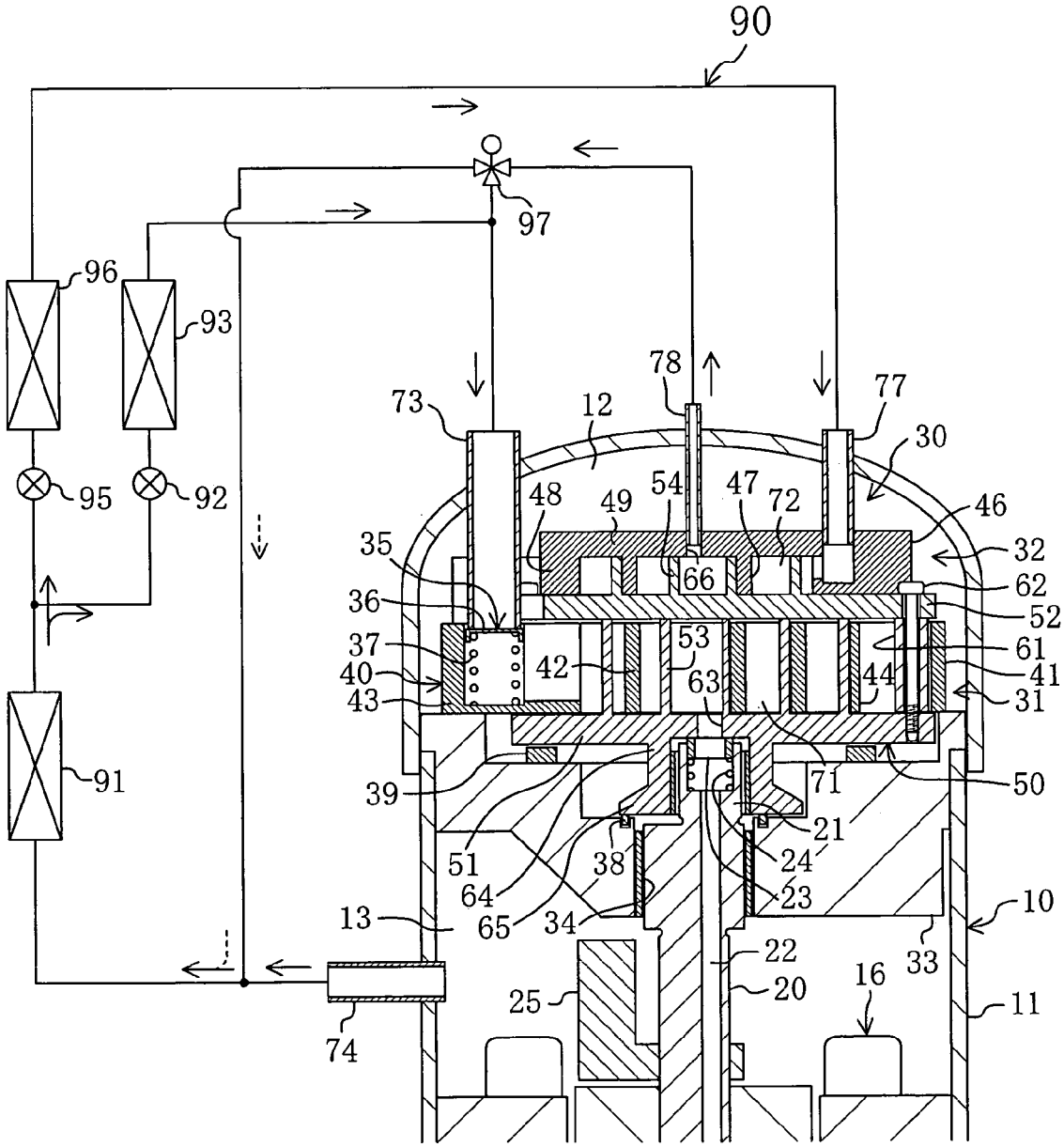
FIG. 10 is a schematic constructional diagram showing a scroll type fluid machine of another variation of the third embodiment and a refrigerant circuit provided with the scroll type fluid machine.

To this end, it may be arranged such that the refrigerant circuit (90) is configured as shown in FIG. 10 so that it becomes switchable between the operation operable by the refrigerant circuit (FIG. 8) and the operation operable by the refrigerant circuit (FIG. 9). The refrigerant circuit (90) of FIG. 10 is a refrigerant circuit obtained by addition of a three-way switching valve (97) to the refrigerant circuit (90) of FIG. 9. The three-way switching valve (97) is disposed in a discharge pipe linked to the second discharge port (78). In the discharge pipe, the three-way switching valve (97) is disposed at a position located nearer to the second discharge port (78) than a position to which the suction pipe extending between the first evaporator (93) and the first suction port (73) is connected. In addition, the three-way switching valve (97) is linked to the discharge pipe linked to the first discharge port (74). The delivery destination of inflow refrigerant from the second discharge port's (78) side is switchable between "to the first suction port's (73) side" and "to the first discharge port (74)" by the three-way switching valve (97). As a result of such arrangement, switching between the operation operable by the refrigerant circuit (FIG. 8) and the operation operable by the refrigerant circuit (FIG. 9) is established, thereby making it possible to perform operations according to the operating condition of the refrigerant circuit.

Embodiment 4 of Invention

A fourth embodiment of the present invention is described. The present embodiment provides a scroll type fluid machine (10) which is configured in the same way as the scroll type fluid machine (10) of the third embodiment. In other words, in the scroll type fluid machine (10) of the present embodiment, both the first and the second volume variation parts (31, 32) are compressors, and the compression ratio in the second volume variation part (32) is greater than the compression ratio in the first volume variation part (31).

Figure 11:
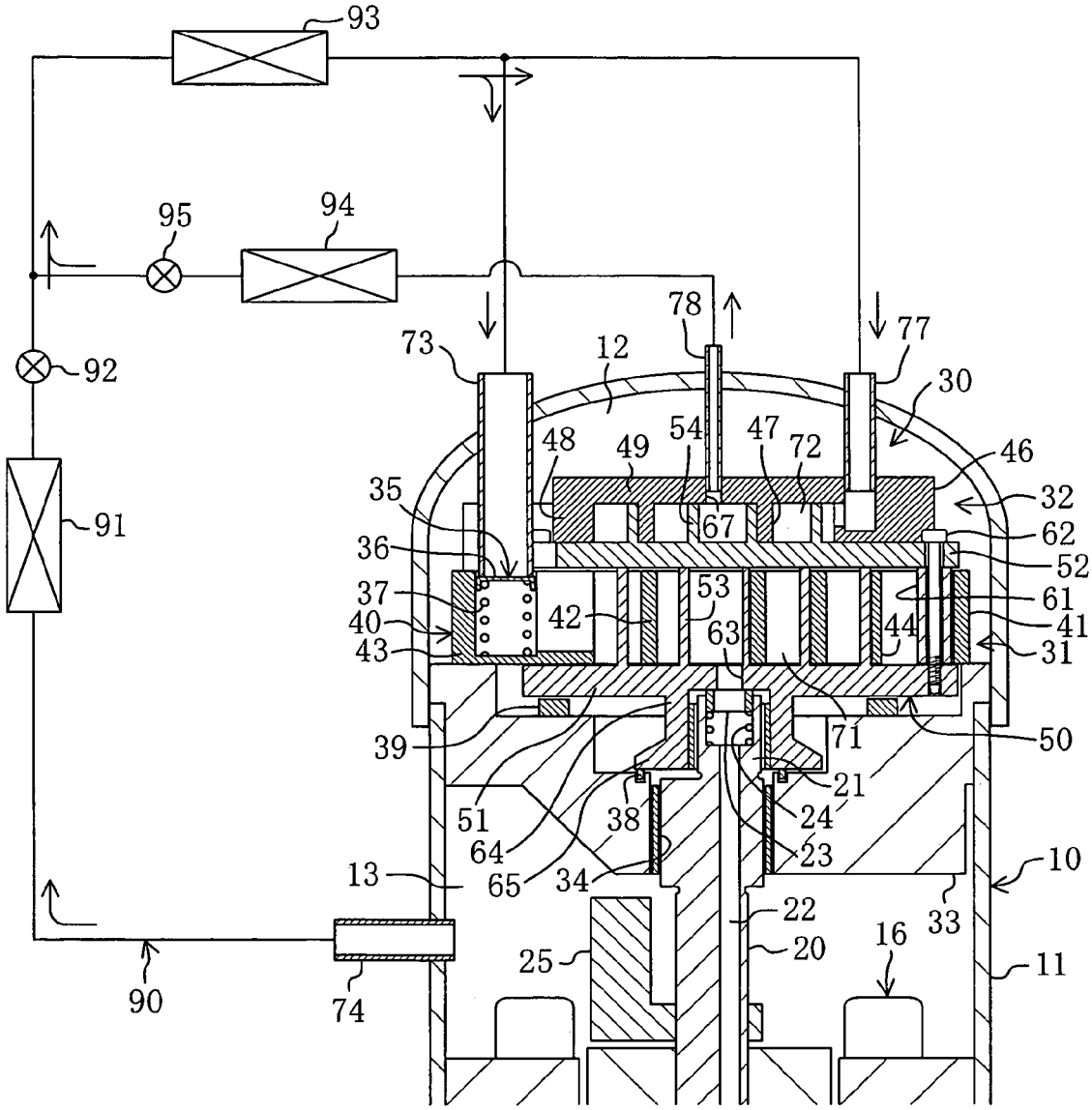
FIG. 11 is a schematic constructional diagram showing a scroll type fluid machine of a fourth embodiment and a refrigerant circuit provided with the scroll type fluid machine.

As shown in FIG. 11, the refrigerant circuit (90) in which the scroll type fluid machine (10) of the present embodiment is disposed is provided with two condensers (91, 94) and two expansion valves (92, 95). In the refrigerant circuit (90), the refrigerant condensation temperature in the second condenser (94) is set higher than the refrigerant condensation temperature in the first condenser (91).

In the refrigerant circuit (90), one end of the first condenser (91) is linked to the first discharge port (74) of the scroll type fluid machine (10) and the other end thereof is linked to one end of the first expansion valve (92). On the other hand, one end of the second condenser (94) is linked to the second discharge port (78) of the scroll type fluid machine (10) and the other end thereof is linked to one end of the second expansion valve (95). One ends of the first and second expansion valves (92, 95) are linked to one end of the evaporator (93). The other end of the evaporator (93) is linked to the first and second suction ports (73, 77) of the scroll type fluid machine (10).

In the scroll type fluid machine (10), refrigerant compressed in the first volume variation part (31) is discharged out through the first discharge port (74) while, on the other hand, refrigerant compressed in the second volume variation part (32) is discharged out through the second discharge port (78). The pressure of the refrigerant discharged out through the second discharge port (78) is higher than the pressure of the refrigerant discharged out through the first discharge port (74). The refrigerant discharged out through the first discharge port (74) condenses in the first condenser (91) and thereafter is reduced in pressure by the first expansion valve (92). On the other hand, the refrigerant discharged out through the second discharge port (78) condenses in the second condenser (94) and thereafter is reduced in pressure by the second expansion valve (95).

The refrigerant pressure-reduced by the first expansion valve (92) and the refrigerant pressure-reduced by the second expansion valve (95) flow into each other, after which the merged refrigerant is introduced into the evaporator (93) where it is evaporated. Then, the flow of the evaporated refrigerant is divided into two branch flows. One of the two refrigerant branch flows is drawn, through the first suction port (73), into the first fluid chamber (71) of the first volume variation part (31). Meanwhile, the rest of the refrigerant, i.e., the other refrigerant branch flow, is drawn, through the second suction port (77), into the second fluid chamber (72) of the second volume variation part (32).

As described above, in accordance with the present embodiment, even in the refrigerant circuit (90) provided with the two condensers (91, 94) which differ from each other in refrigerant condensation temperature, refrigerant compression can be performed by the single scroll type fluid machine (10) alone, thereby making it possible to simplify the configuration of the refrigeration apparatus.

Embodiment 5 of Invention

A fifth embodiment of the present invention is described. The present embodiment provides a scroll type fluid machine (10) which is configured in the same way as the scroll type fluid machine (10) of the third embodiment. In other words, in the scroll type fluid machine (10) of the present embodiment, both the first and the second volume variation parts (31, 32) are compressors. In the scroll type fluid machine (10) of the present embodiment, however, the first and second volume variation parts (31, 32) do not necessarily differ from each other in compression ratio, in other words it may be set such that they have the same compression ratio.

Figure 12:
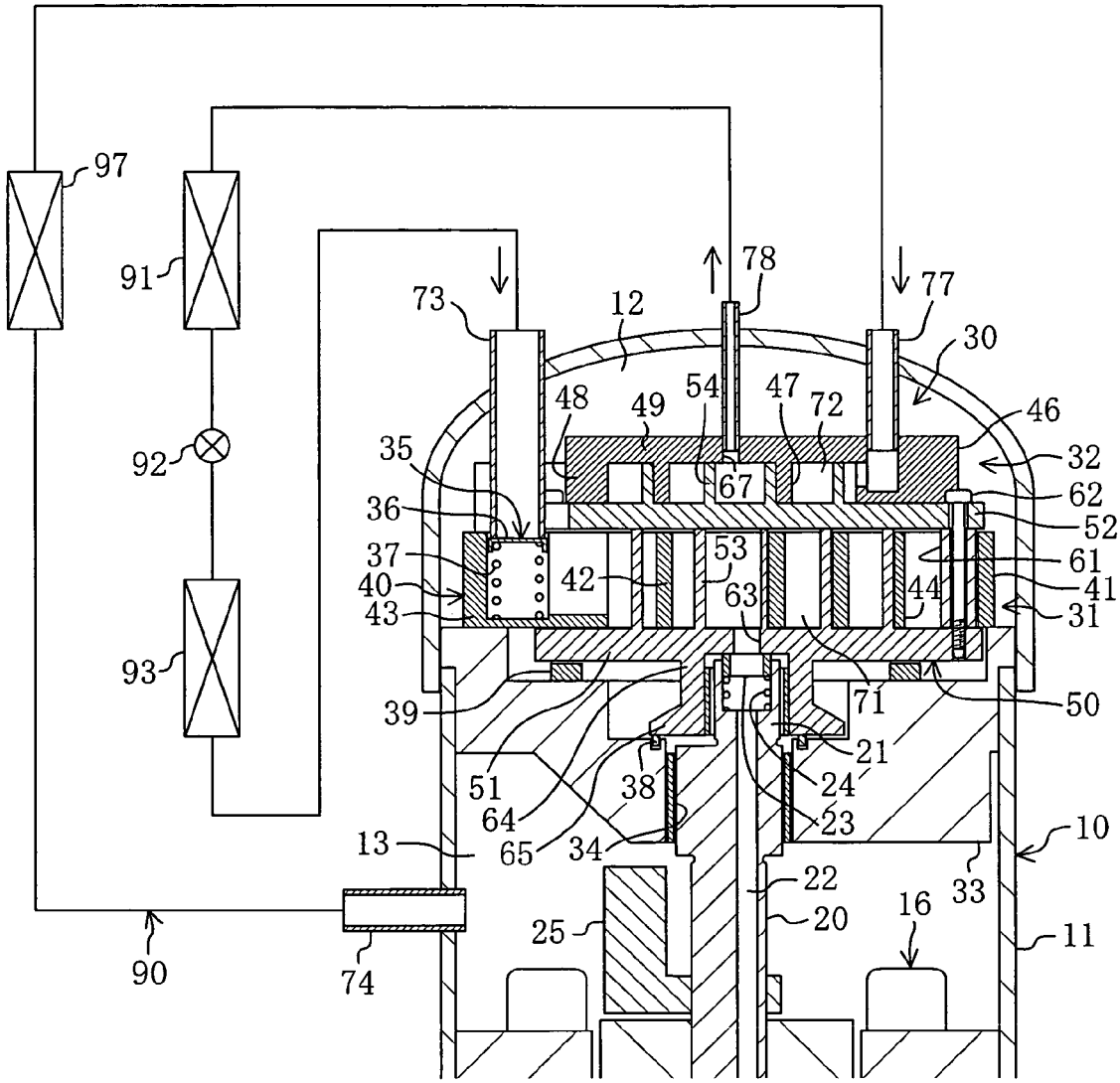
FIG. 12 is a schematic constructional diagram showing a scroll type fluid machine of a fifth embodiment and a refrigerant circuit provided with the scroll type fluid machine.

As shown in FIG. 12, the refrigerant circuit (90) in which the scroll type fluid machine (10) of the present embodiment is disposed is provided with an intermediate heat exchanger (97), in addition to the condenser (91), the expansion valve (92), and the evaporator (93). In the refrigerant circuit (90), two-stage compression refrigeration cycle is performed. In the scroll type fluid machine (10), the first volume variation part (31) constitutes a low-stage side compressor, and the second volume variation part (32) constitutes a high-stage side compressor.

In the refrigerant circuit (90), in the scroll type fluid machine (10) the first discharge port (74) is linked to one end of the intermediate heat exchanger (97), and the second suction port (77) is linked to the other end of the intermediate exchanger (97). The second discharge port (78) of the scroll type fluid machine (10) is linked to one end of the condenser (91). The other end of the condenser (91) is linked, through the expansion valve (92), to one end of the evaporator (93). The other end of the evaporator (93) is linked to the first suction port (73) of the scroll type fluid machine (10).

The scroll type fluid machine (10) draws in the refrigerant evaporated in the evaporator (93) through the first suction port (73). The refrigerant drawn in through the first suction port (73) is drawn into the first fluid chamber (71) of the first volume variation part (31) where it is compressed. The refrigerant compressed in the first volume variation part (31) is discharged out through the first discharge port (74) and cooled in the intermediate heat exchanger (97). Thereafter, the refrigerant is again drawn into the scroll type fluid machine (10) through the second suction port (77). The refrigerant drawn in through the second suction port (77) is drawn into the second fluid chamber (72) of the second volume variation part (32) where it is further compressed. The refrigerant compressed in the second volume variation part (32) is discharged out through the second discharge port (78) and condenses in the condenser (91). Thereafter, the refrigerant is reduced in pressure by the expansion valve (92). Then, the refrigerant flows into the evaporator (93) where it is evaporated.

As described above, in accordance with the present embodiment, both the low-stage side compressor and the high-stage side compressor are constituted by the single scroll type fluid machine (10) alone, thereby making it possible to simplify the configuration of the refrigeration apparatus operable to perform a two-stage compression refrigeration cycle.

Besides, in accordance with the present embodiment, even in the scroll type fluid machine (10) having the movable-side wraps (53, 54) and the stationary-side wraps (42, 47) arranged in two sets and brought into engagement with each other, it is possible to dispose the first movable-side wrap (53) in the center of the front surface of the first flat-plate part (51), as in a general scroll type fluid machine having movable- and stationary-side wraps arranged in only one set. This is the same as the aforesaid third embodiment. Therefore, in accordance with the present embodiment, the outermost diameter of the first and second movable-side wraps (53, 54) on the spiral ending side can be reduced after securing a certain degree of compression ratio, thereby making it possible to downsize the orbiting scroll (50), as in the third embodiment.

Variation of Embodiment 5

The scroll type fluid machine (10) of the present embodiment may be installed in the refrigerant circuit (90) having the following configuration.

Figure 13:
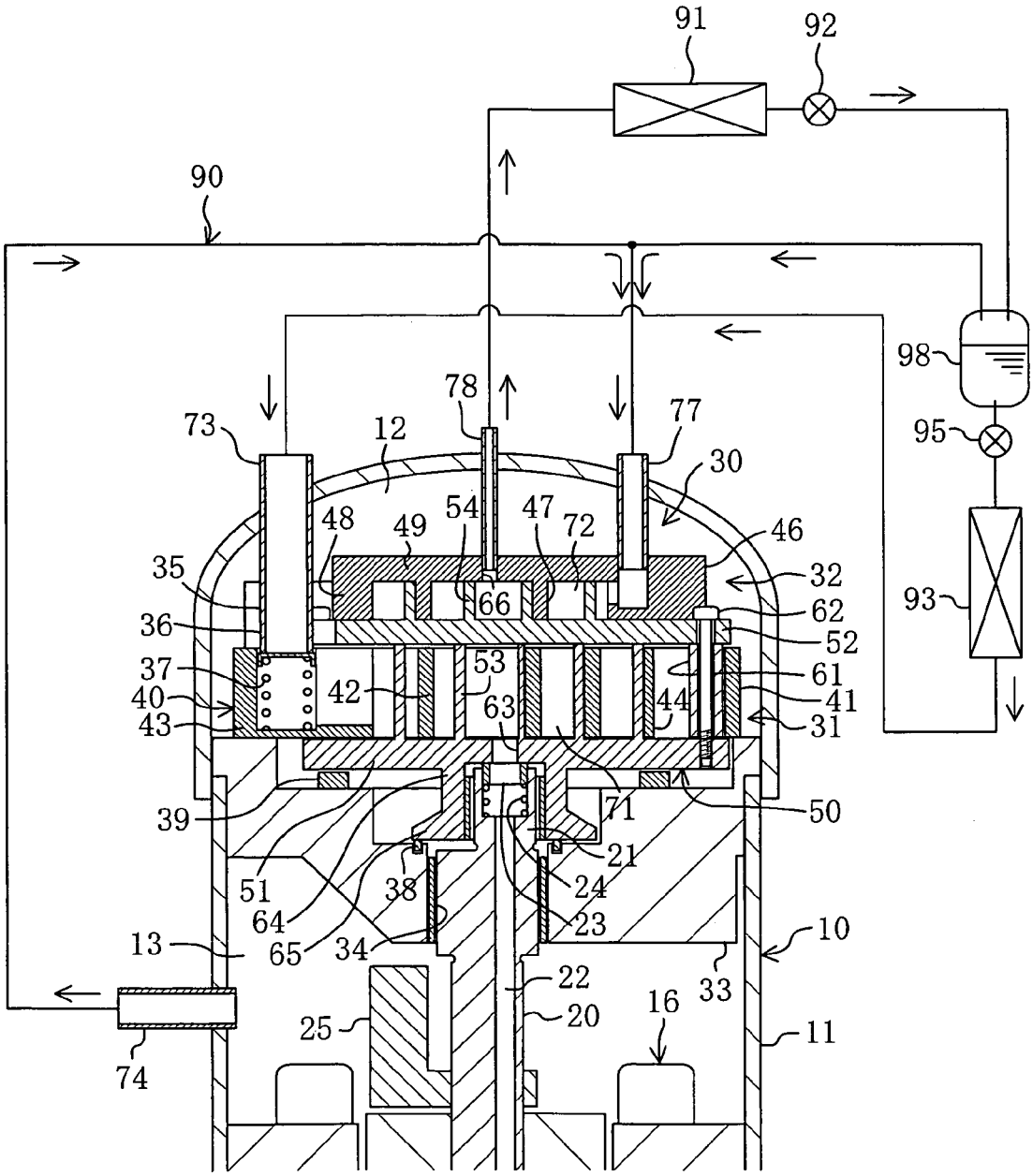
FIG. 13 is a schematic constructional diagram showing a scroll type fluid machine of a variation of the fifth embodiment and a refrigerant circuit provided with the scroll type fluid machine.

As shown in FIG. 13, in the refrigerant circuit (90) of the present variation, the provision of the intermediate heat exchanger (97) is omitted while a second expansion valve (95) and a gas-liquid separator (98) are provided. And, in the refrigerant circuit (90) shown in FIG. 12, the enthalpy of refrigerant which is drawn into the second volume variation part (32) is reduced by heat exchange with air in the intermediate heat exchanger (97). On the other hand, in the refrigerant circuit (90) shown in FIG. 13, the enthalpy of refrigerant which is drawn into the second volume variation part (32) is reduced by mixing of gas refrigerant from the gas-liquid separator (98).

In the refrigerant circuit (90) of the present variation, in the scroll type fluid machine (10) the first discharge port (74) is linked to the second suction port (77). The second discharge port (78) of the scroll type fluid machine (10) is linked to one end of the condenser (91). The other end of the condenser (91) is linked, through the first expansion valve (92), to the top of the gas-liquid separator (98). The top of the gas-liquid separator (98) is also linked to a pipe linking the first discharge port (74) and the second suction port (77). The bottom of the gas-liquid separator (98) is linked, through the second expansion valve (95), to one end of the evaporator (93). The other end of the evaporator (93) is linked to the first suction port (73) of the scroll type fluid machine (10).

The scroll type fluid machine (10) draws in refrigerant evaporated in the evaporator (93) through the first suction port (73). The refrigerant drawn in through the first suction port (73) is drawn into the first fluid chamber (71) of the first volume variation part (31) where it is compressed. Thereafter, the refrigerant is discharged out through the first discharge port (74). The refrigerant discharged out through the first discharge port (74) merges with gas refrigerant of relatively low enthalpy from the gas-liquid separator (98). Thereafter, the merged refrigerant is drawn into the second fluid chamber (72) of the second volume variation part (32) through the second suction port (77) where it is further compressed. The refrigerant compressed in the second volume variation part (32) is discharged out through the second discharge port (78) and condenses in the condenser (91). The refrigerant condensed in the condenser (91) is reduced in pressure during passage through the first expansion valve (92) and enters the gas-liquid two-phase state. Thereafter, the gas-liquid two-phase refrigerant flows into the gas-liquid separator (98). Liquid refrigerant exiting the gas-liquid separator (98) is further reduced in pressure during passage through the second expansion valve (95). Thereafter, the refrigerant flows into the evaporator (93) where it is evaporated.

In the refrigerant circuit (90) of the present variation, only liquid refrigerant separated in the gas-liquid separator (98) is supplied to the evaporator (93). This makes it possible to increase the amount of heat that the refrigerant absorbs in the evaporator (93), thereby accomplishing improvements in cooling capability.

Embodiment 6 of Invention

A sixth embodiment of the present invention is described. The sixth embodiment is similar to the third embodiment, with the exception of modifications in the configuration of the main mechanism (30). Here, the difference between the third embodiment and the present embodiment about the scroll type fluid machine (10) is described.

Figure 14:
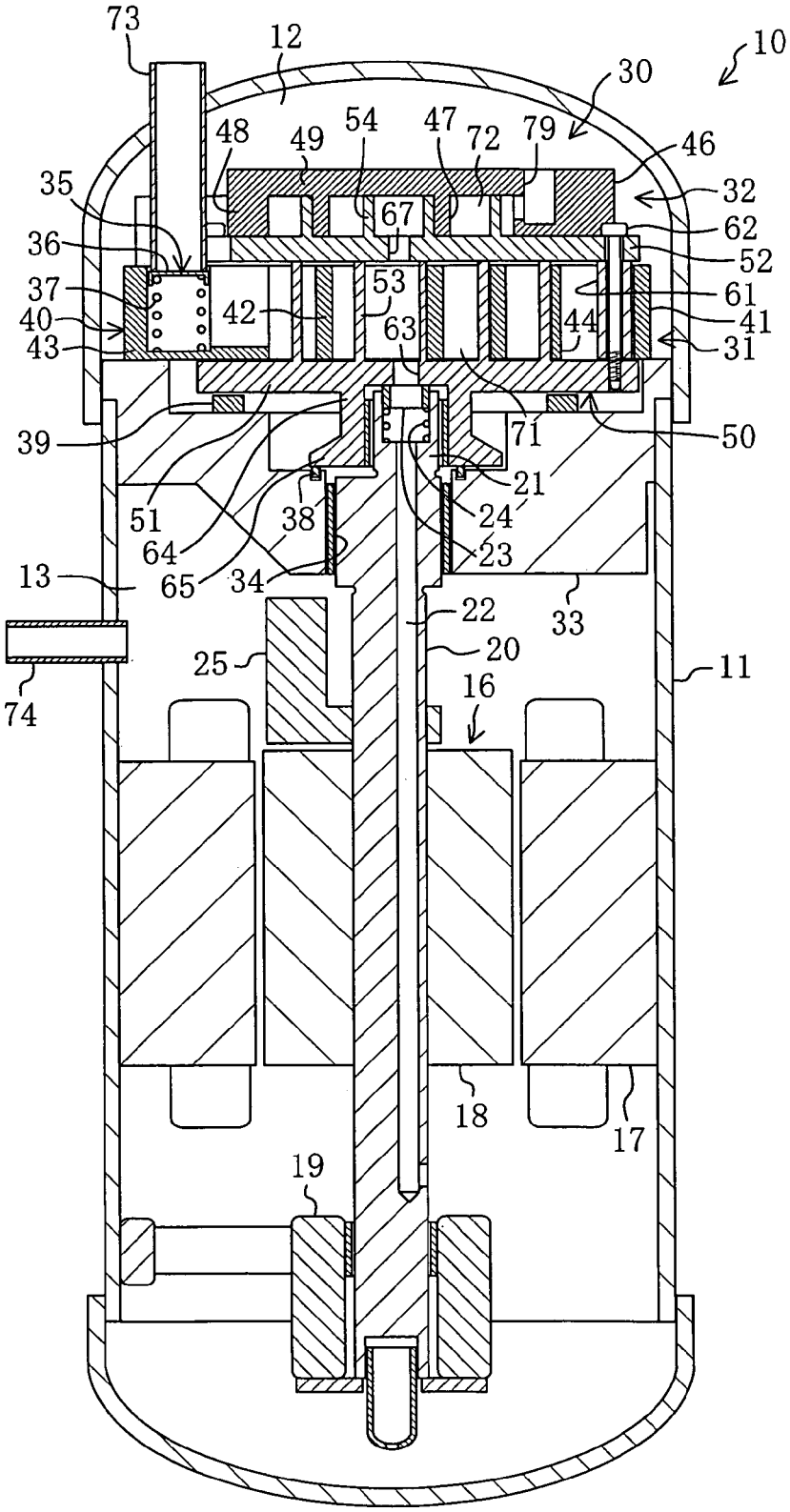
FIG. 14 is a schematic cross sectional view showing the entire arrangement of a scroll type fluid machine of a sixth embodiment of the present invention.

As shown in FIG. 14, in the scroll type fluid machine (10) of the present embodiment, both the first and second volume variation parts (31, 32) are compressors, which is the same as the third embodiment. In the scroll type fluid machine (10), however, it is set such that the compression ratio in the first volume variation part (31) and the compression ratio in the second volume variation part (32) have the same value. That is to say, in the main mechanism (30) of the present embodiment, the ratio of maximum to minimum of the volume of the first fluid chamber (71) agrees with the ratio of maximum to minimum of the volume of the second fluid chamber (72).

In the scroll type fluid machine (10) of the present embodiment, neither the second suction port (77) nor the second discharge port (78) is provided. Only the first suction port (73) and the first discharge port (74) are provided in the casing (11) of the scroll type fluid machine (10). And, although not sown in FIG. 14, the first suction port (73) of the scroll type fluid machine (10) is linked, by a pipe, to the evaporator of the refrigerant circuit, and the first discharge port (74) of the scroll type fluid machine (10) is linked, by a pipe, to the condenser of the refrigerant circuit.

In the main mechanism (30) of the present embodiment, a suction opening (79) opens at the upper surface of the third flat-plate part (49). The second fluid chamber (72) of the second volume variation part (32) is allowed to communicate with the low-pressure chamber (12) through the suction opening (79). In addition, in the main mechanism (30), the second discharge opening (67) is formed not in the third flat-plate part (49) but in the second flat-plate part (52). More specifically, the second discharge opening (67) opens in the vicinity of an end of the second movable-side wrap (54) on the spiral starting side and extends through the second flat-plate part (52).

In the scroll type fluid machine (10), when the orbiting scroll (50) is activated by the electric motor (16), gas refrigerant is drawn to the first suction port (73). A part of the gas refrigerant flowing into the casing (11) through the first suction port (73) is drawn into the first fluid chamber (71) of the first volume variation part (31) and the rest is drawn, through the low-pressure chamber (12) and then through the suction opening (79), into the second fluid chamber (72) of the second volume variation part (32).

With the movement of the first movable-side wrap (53), the refrigerant drawn into the first fluid chamber (71) is compressed and flows, through the first discharge opening (63), into the discharge path (22). On the other hand, with the movement of the second movable-side wrap (54), the refrigerant drawn into the second fluid chamber (72) is compressed and flows, through the second discharge opening (67) and then through the first discharge opening (63), into the discharge path (22). The refrigerant discharged out of the first fluid chamber (71) and the refrigerant discharged out of the second fluid chamber (72) flow, through the discharge path (22), into the high-pressure chamber (13) and are discharged to outside the casing (11) through the first discharge port (74).

Effects of Embodiment 6

Here, for the case of a general scroll compressor including a single movable-side wrap and a single stationary-side wrap, if wrap height is increased in order to increase the displacement amount of the scroll compressor, this makes wrap processing difficult to carry out for the reason that it is difficult to secure wrap processing accuracy. On the other hand, in the main mechanism (30) of the present embodiment, it is arranged such that both the first fluid chamber (71) between the first stationary-side wrap (42) and the first movable-side wrap (53) and the second fluid chamber (72) between the second stationary-side wrap (47) and the second movable-side wrap (54) draw in and compress refrigerant. As a result of such arrangement, it becomes possible to secure a sufficient displacement amount for the entire of the main mechanism (30) while simultaneously keeping the height of each wrap (42, 47, 53, 54) relatively short. Therefore, in accordance with the present embodiment, the displacement amount of the scroll type fluid machine (10) can be set at larger values with the workability of each wrap (42, 47, 53, 54) remaining intact.

In addition, in the main mechanism (30) of the present embodiment, it is possible to set the displacement amount at different values by only making changes in the height of the second stationary-side wrap (47) and the second movable-side wrap (54) without changing the height of the first stationary-side wrap (42) and the first movable-side wrap (53). Therefore, in accordance with the present embodiment, even when manufacturing plural types of scroll type fluid machines (10) having different displacement amounts, the increase in the number of component part types due to such manufacture is suppressed, thereby making it possible to cut down the manufacturing cost of the scroll type fluid machine (10).

Embodiment 7 of Invention

A seventh embodiment of the present invention is described. The seventh embodiment is similar to the first embodiment, with the exception of modifications in the configuration of the main mechanism (30). Here, the difference between the first embodiment and the present embodiment about the scroll type fluid machine (10) is described.

Figure 15:
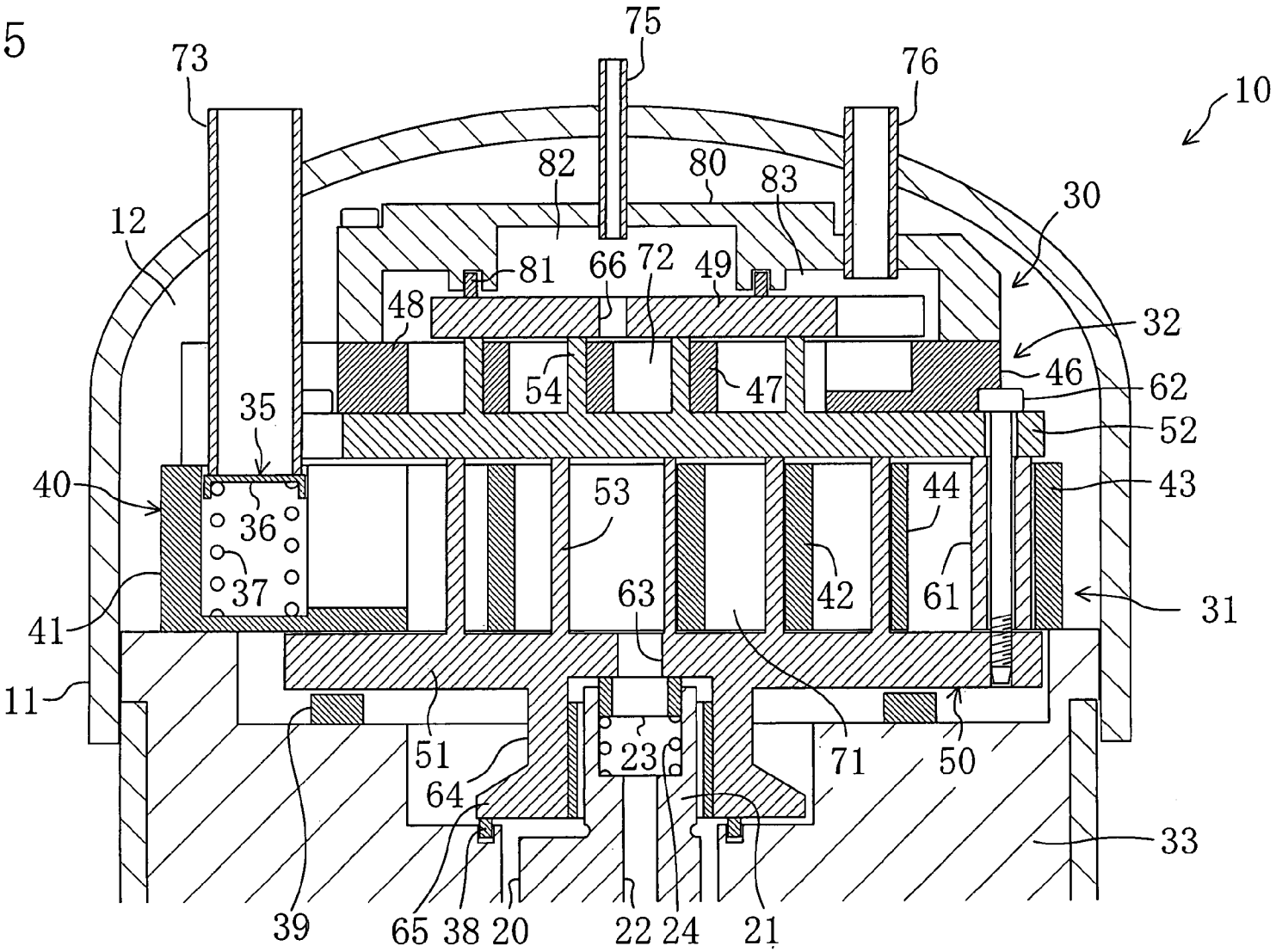
FIG. 15 is an enlarged cross sectional view showing a major part of a scroll type fluid machine of a seventh embodiment of the present invention.

As shown in FIG. 15, in the main mechanism (30) of the present embodiment, the third flat-plate part (49) is shaped like a circular disc having a slightly smaller diameter than that of the second flat-plate part (52) and is attached to the orbiting scroll (50). That is, in the main mechanism (30), the third flat-plate part (49) is mounted not on the second stationary-side member (46) but on the orbiting scroll (50). In the main mechanism (30), the third flat-plate part (49) makes an orbital motion together with the second flat-plate part (52) and the second movable-side wrap (54), and its lower surface is in sliding contact with the upper end surface of the second stationary-side wrap (47).

In the main mechanism (30), the second stationary-side member (46) is made up of a second outer peripheral part (48) and a second stationary-side wrap (47). In the second stationary-side member (46), the second stationary-side wrap (47) projects, in the form of a cantilever beam, from the inner peripheral surface of the second outer peripheral part (48). In other words, the second stationary-side member (46) is formed such that it has the same shape as that of the first stationary-side member (41) (see FIG. 3).

In the main mechanism (30), the first volume variation part (31) is made up of a first flat-plate part (51), a second flat-plate part (52) and a first movable-side wrap (53) of the orbiting scroll (50), and a first stationary-side member (41) of the fixed scroll (40) having a first stationary-side wrap (42). This is the same as in the first embodiment. On the other hand, the second volume variation part (32), unlike the one in the first embodiment, is made up of a second flat-plate part (52), a third flat-plate part (49) and a second movable-side wrap (54) of the orbiting scroll (50), and a second stationary-side member (46) of the fixed scroll (40) having a second stationary-side wrap (47).

The main mechanism (30) is provided with a cover member (80). The cover member (80) is shaped like a circular dish turned upside down. The cover member (80) is attached to the second stationary-side member (46) and provides a covering over the third flat-plate part (49). Disposed between the cover member (80) and the third flat-plate part (49) is a seal ring (81). The seal ring (81) is fitted into a concave annular groove formed in the cover member (80) and its lower end surface is in sliding contact with the upper surface of the third flat-plate part (49). In addition, the seal ring (81) is arranged such that it encompasses the circumference of the inflow opening (66) in the third flat-plate part (49). And, of the space defined between the cover member (80) and the second stationary-side member (46), a space inside the seal ring (81) constitutes a high-pressure space (82) and a space outside the seal ring (81) constitutes a low-pressure space (83).

In the main mechanism (30), both the inflow port (75) and the outflow port (76) are attached to the cover member (80). And, one end of the inflow port (75) opens to the high-pressure space (82) and one end of the outflow port (76) opens to the low-pressure space (83). In the scroll type fluid machine (10) of the present embodiment, the inflow refrigerant into the inflow port (75) first flows into the high-pressure space (82) and thereafter is introduced, through the inflow opening (66), into the second fluid chamber (72). On the other hand, the refrigerant which is sent out from the second fluid chamber (72) is delivered to the outflow port (76) through the low-pressure space (83).

In the main mechanism (30) of the present embodiment, the second flat-plate part (52) (which zones, together with the first flat-plate part (51), the first fluid chamber (71)) and the third flat-plate part (49) (which zones, together with the second flat-plate part (52), the second fluid chamber (72)) are provided in the orbiting scroll (50). Although the inner pressure of the first fluid chamber (71) acts on the first flat-plate part (51) and on the second flat-plate part (52), the force acting on the first flat-plate part (51) and the force acting on the second flat-plate part (52) are the same in magnitude but act in opposite directions. Likewise, although the inner pressure of the second fluid chamber (72) acts on the second flat-plate part (52) and on the third flat-plate part (49), the force acting on the second flat-plate part (52) and the force acting on the third flat-plate part (49) are the same in magnitude but act in opposite directions. Consequently, the force exerted by the fluid in the first fluid chamber (71) onto the first flat-plate part (51) and the force exerted by the fluid in the first fluid chamber (71) onto the second flat-plate part (52) are offset against each other, and the force exerted by the fluid in the second fluid chamber (72) onto the second flat-plate part (52) and the force exerted by the fluid in the second fluid chamber (72) onto the third flat-plate part (49) are also offset against each other.

Therefore, in accordance with the present embodiment, the force that the orbiting scroll (50) receives from the fluid in each of the fluid chambers (71, 72) can be made apparently nil, thereby making it possible to considerably reduce the axial load (i.e., thrust load) acting on the orbiting scroll (50). As a result, the frictional loss during the orbital motion of the orbiting scroll (50) is considerably reduced, thereby making it possible to improve the efficiency of the scroll type fluid machine (10).

Here, the oil pressure of refrigeration oil acts on the inside of the seal ring (38) at the bottom of the collar part (65). By the oil pressure, an upward load acts on the orbiting scroll (50). In addition, the pressure of gas within the high-pressure space (82) acts on the inside of the seal ring (81) at the upper surface of the third flat-plate part (49). By the gas pressure, a downward load acts on the orbiting scroll (50). Therefore, in accordance with the present embodiment, if the diameter of the two seal rings (38, 81) is set to adequate values, this makes it possible to establish a balance between the upward load by oil pressure and the downward load by gas pressure. It is also possible to null the thrust load acting on the orbiting scroll (50).

Variation of Embodiment 7

As described above, in the present embodiment, the arrangement that the third flat-plate part (49), formed as a different body from the second stationary-side member (46), is provided in the orbiting scroll (50) is applied to the main mechanism (30) of the first embodiment. However, for such an arrangement that the third flat-plate part (49) is provided in the orbiting scroll (50), its target of application is not limited to the main mechanism (30) of the first embodiment, and it is applicable to the main mechanism (30) of each of the third to sixth embodiments. In other words, the arrangement that the third flat-plate part (49) is provided in the orbiting scroll (50) is applicable to the scroll type fluid machine (10) in which both the first volume variation part (31) and the second volume variation part (32) are compressors.

Other Embodiments

In the third to sixth embodiments, in the main mechanism (30) of the scroll type fluid machine (10), both the first movable- and stationary-side wraps (53, 42) and the second movable- and stationary side wraps (54, 47) spiral in the same direction, and both the first volume variation part (31) and the second volume variation part (32) are compressors. However, in the scroll type fluid machine (10) in which both the first movable- and stationary-side wraps (53, 42) and the second movable- and stationary side wraps (54, 47) spiral in the same direction, both the first volume variation part (31) and the second volume variation part (32) may be not compressors but expanders.

Additionally, each of the foregoing embodiments employs the configuration that the tubular bearing part (64) is formed on the back surface side of the first flat-plate part (51) and the eccentric part (21) formed at the upper end of the drive shaft (20) is inserted into the bearing part (64). Instead, the following configuration may be employed. That is, a cylindrical projecting part is formed on the back surface side of the first flat-plate part (51) and a hole part is formed at the upper end of the drive shaft (20). The projecting part of the first flat-plate part (51) is inserted into the hole part of the drive shaft (20) so that the orbiting scroll (50) is brought into engagement with the drive shaft (20). In this case, the projecting part projectingly formed on the back surface of the first flat-plate part (51) constitutes an engaging part.

INDUSTRIAL APPLICABILITY

As has been described above, the present invention is useful with scroll type fluid machinery in which fluid compression and fluid expansion are performed.

What is claimed is:

1. A scroll type fluid machine comprising a fixed scroll (40), an orbiting scroll (50), a rotating shaft (20) which engages the orbiting scroll (50), and a self-rotation preventing mechanism (39) for preventing the orbiting scroll (50) from rotating, wherein:

the fixed scroll (40) comprises a first stationary-side member (41) provided with a first stationary-side wrap (42), and a second stationary-side member (46) provided with a second stationary-side wrap (47), the orbiting scroll (50) comprises: a first flat-plate part (51) having a back surface on which is provided an engaging part (64) which engages the rotating shaft (20), and a front surface which comes into sliding contact with the first stationary-side wrap (42); a first movable-side wrap (53) which forms a first fluid chamber (71) when engaged with the first stationary-side wrap (42); a second flat-plate part (52) which faces the first flat-plate part (51) across the first movable-side wrap (53) and which has a rear surface coming into sliding contact with the first stationary-side wrap (42) and a front surface coming into sliding contact with the second stationary-side wrap (47); and a second movable-side wrap (54) which forms a second fluid chamber (72) when engaged with the second stationary-side wrap (47), and the second stationary-side member (46) is provided with a third flat-plate part (49) which faces the second flat-plate part (52) across the second movable-side wrap (54) and which comes into sliding contact with the second movable-side wrap (54).

2. A scroll type fluid machine comprising a fixed scroll (40), an orbiting scroll (50), a rotating shaft (20) which engages the orbiting scroll (50), and a self-rotation preventing mechanism (39) for preventing the orbiting scroll (50) from rotating, wherein:

the fixed scroll (40) comprises a first stationary-side member (41) provided with a first stationary-side wrap (42), and a second stationary-side member (46) provided with a second stationary-side wrap (47), the orbiting scroll (50) comprises: a first flat-plate part (51) having a back surface on which is provided an engaging part (64) which engages the rotating shaft (20), and a front surface which comes into sliding contact with the first stationary-side wrap (42); a first movable-side wrap (53) which forms a first fluid chamber (71) when engaged with the first stationary-side wrap (42); a second flat-plate part (52) which faces the first flat-plate part (51) across the first movable-side wrap (53) and which has a rear surface coming into sliding contact with the first stationary-side wrap (42) and a front surface coming into sliding contact with the second stationary-side wrap (47); a second movable-side wrap (54) which forms a second fluid chamber (72) when engaged with the second stationary-side wrap (47); and a third flat-plate part (49) which faces the second flat-plate part (52) across the second movable-side wrap (54) and which comes into sliding contact with the second stationary-side wrap (47).

3. The scroll type fluid machine of claim 1 or claim 2, wherein:

the first movable-side wrap (53) is formed integrally with the first flat-plate part (51), and the second flat-plate (52) is formed as a different body from the first flat-plate part (51) and the first movable-side wrap (53).

4. The scroll type fluid machine of claim 3, wherein the second movable-side wrap (54) is formed integrally with the second flat-plate part (52).

5. The scroll type fluid machine of claim 1 or claim 2, wherein the spiral direction of the first stationary- and movable-side wraps (42, 53) differs from the spiral direction of the second stationary- and movable-side wraps (47, 54).

6. The scroll type fluid machine of claim 5, wherein, when the orbiting scroll (50) makes an orbital motion, fluid compression takes place in the first fluid chamber (71) while fluid expansion takes place in the second fluid chamber (72).

7. The scroll type fluid machine of claim 6, wherein:

plural introduction openings (66, 68, 69) in communication with the second fluid chamber (72) are formed in different positions of the third flat-plate part (49) relative to the radial direction of the second stationary-side wrap (47) or relative to the radial direction of the second movable-side wrap (54), and an opening/closing mechanism (85) for opening and closing each introduction opening (66, 68, 69) is provided.

8. The scroll type fluid machine of claim 1 or claim 2, wherein the spiral direction of the first stationary- and movable-side wraps (42, 53) is the same as the spiral direction of the second stationary- and movable-side wraps (47, 54).

9. The scroll type fluid machine of claim 8, wherein the ratio of maximum to minimum of the volume of the first fluid chamber (71) differs from the ratio of maximum to minimum of the volume of the second fluid chamber (72).

10. The scroll type fluid machine of claim 8, wherein the ratio of maximum to minimum of the volume of the first fluid chamber (71) is the same as the ratio of maximum to minimum of the volume of the second fluid chamber (72).

11. The scroll type fluid machine of claim 8, wherein a fluid compressed in either one of the first and second fluid chambers (71, 72) is introduced into the other fluid chamber for further compression.

* * * * *